US009238848B2

(12) United States Patent
Suwa et al.

(10) Patent No.: US 9,238,848 B2
(45) Date of Patent: Jan. 19, 2016

(54) HIGH-STRENGTH STEEL SHEET AND METHOD FOR PRODUCING SAME

(75) Inventors: Yoshihiro Suwa, Tokyo (JP); Kenichi Yamamoto, Tokyo (JP); Daisuke Maeda, Tokyo (JP); Satoshi Hirose, Tokyo (JP); Genichi Shigesato, Tokyo (JP); Naoki Yoshinaga, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 57 days.

(21) Appl. No.: 13/636,993

(22) PCT Filed: May 10, 2011

(86) PCT No.: PCT/JP2011/060760

§ 371 (c)(1),
(2), (4) Date: Sep. 24, 2012

(87) PCT Pub. No.: WO2011/142356

PCT Pub. Date: Nov. 17, 2011

(65) Prior Publication Data

US 2013/0008568 A1 Jan. 10, 2013

(30) Foreign Application Priority Data

May 10, 2010 (JP) ..... 2010-108431
Jun. 11, 2010 (JP) ..... 2010-133709

(51) Int. Cl.
*C22F 1/10* (2006.01)
*C21D 8/02* (2006.01)
(Continued)

(52) U.S. Cl.
CPC ..... *C21D 8/0226* (2013.01); *C21D 6/005* (2013.01); *C21D 8/0236* (2013.01); *C22C 38/001* (2013.01); *C22C 38/005* (2013.01);
(Continued)

(58) Field of Classification Search
USPC ..... 148/330, 331, 522, 541
See application file for complete search history.

(56) References Cited

U.S. PATENT DOCUMENTS

2010/0112377 A1* 5/2010 Kaneko et al. ..... 428/659
2011/0076512 A1* 3/2011 Yamamoto et al. ..... 428/639

FOREIGN PATENT DOCUMENTS

JP 55-115923 A 9/1980
JP 59-96218 A 6/1984
(Continued)

OTHER PUBLICATIONS

International Search Report issued in PCT/JP2011/060760, dated Jul. 26, 2011.
(Continued)

*Primary Examiner* — Kaj K Olsen
*Assistant Examiner* — Alexander Polyansky
(74) *Attorney, Agent, or Firm* — Birch, Stewart, Kolasch & Birch, LLP

(57) ABSTRACT

A high-strength steel sheet includes, by mass %, C: 0.03% to 0.30%, Si: 0.08% to 2.1%, Mn: 0.5% to 4.0%, P: 0.05% or less, S: 0.0001% to 0.1%, N: 0.01% or less, acid-soluble Al: more than 0.004% and less than or equal to 2.0%, acid-soluble Ti: 0.0001% to 0.20%, at least one selected from Ce and La: 0.001% to 0.04% in total, and a balance of iron and inevitable impurities, in which [Ce], [La], [acid-soluble Al], and [S] satisfy $0.02 \leq ([Ce]+[La])/[\text{acid-soluble Al}] < 0.25$, and $0.4 \leq ([Ce]+[La])/[S] \leq 50$ in a case in which the mass percentages of Ce, La, acid-soluble Al, and S are defined to be [Ce], [La], [acid-soluble Al], and [S], respectively, and a microstructure includes 1% to 50% of martensite in terms of an area ratio.

19 Claims, 2 Drawing Sheets

(51) Int. Cl.

| | |
|---|---|
| ***C22C 38/00*** | (2006.01) |
| ***C21D 6/00*** | (2006.01) |
| ***C22C 38/14*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C22C 38/02* (2013.01); *C22C 38/04* (2013.01); *C22C 38/06* (2013.01); *C22C 38/14* (2013.01); *C21D 2211/005* (2013.01); *C21D 2211/008* (2013.01)

(56) References Cited

FOREIGN PATENT DOCUMENTS

| | | | | | |
|---|---|---|---|---|---|
| JP | 6-128688 | A | | 5/1994 | |
| JP | 2000-319756 | A | | 11/2000 | |
| JP | 2001-200331 | A | | 7/2001 | |
| JP | 2004-339593 | A | | 12/2004 | |
| JP | 2005-120436 | A | | 5/2005 | |
| JP | 2005-298896 | A | | 10/2005 | |
| JP | 2005-307301 | A | | 11/2005 | |
| JP | 1860249 | A | | 11/2006 | |
| JP | 2007-146280 | A | | 6/2007 | |
| JP | 2007146280 | A | * | 6/2007 | ..... C22C 38/00 |
| JP | 2007-231369 | A | | 9/2007 | |
| JP | 2008-274336 | A | | 11/2008 | |
| JP | 2009-299137 | A | | 12/2009 | |
| KR | 20090018167 | A | | 2/2009 | |

OTHER PUBLICATIONS

Chinese Office Action dated Jan. 25, 2014, issued in Chinese Patent Application No. 201180023000.8.

Korean Notice of Decision to Grant, dated Aug. 4, 2014 for Application No. 10-2012-7030367 with English language translation.

* cited by examiner

HIGH-STRENGTH STEEL SHEET AND METHOD FOR PRODUCING SAME

FIELD OF THE INVENTION

The present invention relates to a high-strength steel sheet which can be preferably mainly pressed and used in the underbody parts of automobiles and the like and structural materials, and is excellent in terms of hole expansion and ductility, and a method of producing the same.

Priority is claimed on Japanese Patent Application No. 2010-108431, filed May 10, 2010, and Japanese Patent Application No. 2010-133709, filed Jun. 11, 2010, the contents of which are incorporated herein by reference.

DESCRIPTION OF RELATED ART

A steel sheet used for the structure of an automobile body needs to have favorable formability and strength. As a high-strength steel sheet having both formability and high strength, a steel sheet composed of ferrite and martensite, a steel sheet composed of ferrite and bainite, a steel sheet including retained austenite in the microstructure, and the like are known.

The above complex microstructure steel sheets are disclosed in, for example, Patent Citations 1 to 3. However, there is a demand for a complex microstructure steel sheet having more favorable hole expansion than in the conventional technique in order to meet demands for an additional decrease in the weight of modern automobiles and the capability of parts to have more complicated shapes.

A complex microstructure steel sheet including martensite dispersed in a ferrite matrix has a low yield ratio, a high tensile strength, and an excellent elongation. However, in the complex microstructure steel sheet, stress concentrates on the interfaces between ferrite and martensite, cracks easily occur at the interfaces, and thus the complex microstructure steel sheet has the disadvantage of poor hole expansion.

In contrast to the above, Patent Citation 4 discloses a high-strength hot-rolled steel sheet having excellent hole expansion that are required for the recent wheel and underbody member materials. In Patent Citation 4, the amount of C in the steel sheet is decreased as much as possible so that a solid solution-hardened or precipitation-hardened ferrite is included in the steel sheet which includes bainite as a major part of the microstructure at an appropriate volume fraction, the difference in hardness between the ferrite and the bainite decreases, and generation of coarse carbides is prevented.

In addition, Patent Citations 5 and 6 disclose methods in which MnS-based coarse inclusions present in slabs are dispersed and precipitated in a steel sheet as fine spherical inclusions which include MnS so as to provide a high-strength steel sheet that is excellent in terms of hole expansion without deteriorating fatigue characteristics. In Patent Citation 5, deoxidation is carried out by adding Ce and La without substantially adding Al, and fine MnS is precipitated on fine and hard Ce oxides, La oxides, cerium oxysulfides, and lanthanum oxysulfides, all of which are generated by the deoxidation. In this technique, MnS does not elongate during rolling, and therefore the MnS does not easily serve as a starting point of cracking or crack propagation path, and the hole expansion can be improved.

PATENT CITATION

[Patent Citation 1] Japanese Unexamined Patent Application, First Publication No. H6-128688

[Patent Citation 2] Japanese Unexamined Patent Application, First Publication No. 2000-319756

[Patent Citation 3] Japanese Unexamined Patent Application, First Publication No. 2005-120436

[Patent Citation 4] Japanese Unexamined Patent Application, First Publication No. 2001-200331

[Patent Citation 5] Japanese Unexamined Patent Application, First Publication No. 2007-146280

[Patent Citation 6] Japanese Unexamined Patent Application, First Publication No. 2008-274336

SUMMARY OF THE INVENTION

Problems to be Solved by the Invention

The high-strength hot-rolled steel sheet as disclosed in Patent Citation 4, in which a major part of the microstructure is bainite, and generation of coarse carbides is suppressed, exhibits excellent hole expansion, but the ductility is poor compared to a steel sheet mainly including ferrite and martensite. In addition, while generation of coarse carbides is suppressed, it is still difficult to prevent occurrence of cracks in a case in which a strict hole expanding is carried out.

According to studies by the inventors, it was found that the above disadvantages result from elongated sulfide-based inclusions mainly including MnS in the steel sheet. When the steel sheet is repeatedly deformed, internal defects are caused in the vicinity of elongated coarse MnS-based inclusions that are present in and in the vicinity of the surface layer of the steel sheet, the internal defects propagate as cracks, and the fatigue characteristics deteriorate. In addition, the elongated coarse MnS-based inclusions become liable to serve as starting points of cracking during a hole expanding.

Therefore, it is desirable to make MnS-based inclusions in steel into a fine spherical shape while preventing the MnS-based inclusions from being elongated as much as possible.

However, since Mn is an element that increases the strength of materials together with C or Si, in a high-strength steel sheet, it is common to set the concentration of Mn to a high percentage in order to secure the strength. Furthermore, when a heavy treatment for desulfurization is not carried out in a secondary refining, 50 ppm or more of S is included in steel. Therefore, generally, MnS is present in slabs.

In addition, when the concentration of soluble Ti is increased in order to improve stretch flangeability, the soluble Ti partially bonds with coarse TiS and MnS so as to precipitate (Mn, Ti)S.

Since MnS-based inclusions (hereinafter, three inclusions of MnS, TiS, and (Mn, Ti)S will be referred to as "MnS-based inclusions" for convenience) are liable to deform when steels are hot-rolled or cold-rolled, the MnS-based inclusions are elongated, which causes degradation of hole expansion.

In contrast to Patent Citation 4, in Patent Citations 5 and 6, since fine MnS-based inclusions are precipitated in slabs, and the MnS-based inclusions are dispersed in the steel sheet as fine spherical inclusions that do not easily serve as starting points of cracking while not deforming during rolling, it is possible to manufacture a hot-rolled steel sheet that is excellent in terms of hole expansion.

However, in Patent Citation 5, since the steel sheet has a microstructure mainly including bainite, sufficient ductility cannot be expected compared to a steel sheet having microstructures mainly including ferrite and martensite. In addition, in a steel sheet having microstructures mainly including ferrite and martensite, which are significantly different in hardness, hole expansion are not significantly improved even when MnS-based inclusions are finely precipitated using the techniques of Patent Citations 5 and 6.

The present invention has been made to solve the problems of the conventional techniques, and provides a complex microstructure type high-strength steel sheet that is excellent in terms of hole expansion and ductility, and a method of manufacturing the same.

Methods for Solving the Problem

Hole expansion are a characteristic that is dependent on the uniformity of the microstructure, and, in a multiphase steel sheet mainly including ferrite and martensite having a large difference in hardness in the microstructure, stress concentrates in the interfaces between the ferrite and the martensite, and cracks are liable to occur at the interfaces. Additionally, the hole expansion are significantly deteriorated by sulfide-based inclusions in which MnS and the like are elongated.

As a result of thorough studies, the inventors found that, when chemical components and manufacturing conditions are adjusted so as to prevent the hardness of a martensite phase (martensite) in a multiphase steel sheet mainly including ferrite and martensite from excessively increasing, and MnS-based inclusions are finely precipitated through deoxidation by addition of Ce and La, hole expansion can be significantly improved even in a steel sheet having a microstructure in which ferrite and martensite are mainly included, and completed the present invention.

Meanwhile, an example in which TiN is precipitated on fine and hard Ce oxides, La oxides, cerium oxysulfides, and lanthanum oxysulfides together with MnS-based inclusions was also observed, but it was confirmed that such an example has little influence on hole expansion and ductility.

Therefore, in the present invention, TiN will not be taken into account as a partner of MnS-based inclusions.

The purports of the present invention are as follows:

(1) A high-strength steel sheet according to an aspect of the present invention includes, by mass %, C, 0.03% to 0.30%, Si: 0.08% to 2.1%, Mn: 0.5% to 4.0%, P: 0.05% or less, S: 0.0001% to 0.1%, N, 0.01% or less, acid-soluble Al: more than 0.004% and less than or equal to 2.0%, acid-soluble Ti: 0.0001% to 0.20%, at least one selected from Ce and La: 0.001% to 0.04% in total, and a balance of iron and inevitable impurities, in which [Ce], [La], [acid-soluble Al], and [S] satisfy $0.02 \leq ([Ce]+[La])/[\text{acid-soluble Al}] < 0.25$, and $0.4 \leq ([Ce]+[La])/[S] \leq 50$ in a case in which the mass percentages of Ce, La, acid-soluble Al, and S are defined to be [Ce], [La], [acid-soluble Al], and [S], respectively, and the microstructure of the high-strength steel sheet includes 1% to 50% of martensite in terms of an area ratio.

(2) The high-strength steel sheet according to the above (1) may further include, by mass %, at least one selected from a group consisting of Mo: 0.001% to 1.0%, Cr: 0.001% to 2.0%, Ni: 0.001% to 2.0%, Cu: 0.001% to 2.0%, B: 0.0001% to 0.005%, Nb: 0.001% to 0.2%, V: 0.001% to 1.0%, W: 0.001% to 1.0%, Ca: 0.0001% to 0.01%, Mg: 0.0001% to 0.01%, Zr: 0.0001% to 0.2%, at least one selected from Sc and lanthanoids of Pr through Lu: 0.0001% to 0.1%, As: 0.0001% to 0.5%, Co: 0.0001% to 1.0%, Sn: 0.0001% to 0.2%, Pb: 0.0001% to 0.2%, Y: 0.0001% to 0.2%, and Hf: 0.0001% to 0.2%.

(3) In the high-strength steel sheet according to the above (1) or (2), the amount of the acid-soluble Ti may be more than or equal to 0.0001% and less than 0.008%.

(4) In the high-strength steel sheet according to the above (1) or (2), the amount of the acid-soluble Ti may be 0.008% to 0.20%.

(5) In the high-strength steel sheet according to the above (1) or (2), [Ce], [La], [acid-soluble Al], and [S] may satisfy $0.02 \leq ([Ce]+[La])/[\text{acid-soluble Al}] < 0.15$.

(6) In the high-strength steel sheet according to the above (1) or (2), [Ce], [La], [acid-soluble Al], and [S] may satisfy $0.02 \leq ([Ce]+[La])/[\text{acid-soluble Al}] < 0.10$.

(7) In the high-strength steel sheet according to the above (1) or (2), the amount of acid-soluble Al may be more than 0.01% and less than or equal to 2.0%.

(8) In the high-strength steel sheet according to the above (1) or (2), the number density of inclusions having an equivalent circle diameter of 0.5 μm to 2 μm in the microstructure may be 15 inclusions/$mm^2$ or more.

(9) In the high-strength steel sheet according to the above (1) or (2), of inclusions having an equivalent circle diameter of 1.0 μm or more in the microstructure, the number percentage of elongated inclusions having an aspect ratio of 5 or more obtained by dividing the long diameter by the short diameter may be 20% or less.

(10) In the high-strength steel sheet according to the above (1) or (2), of inclusions having an equivalent circle diameter of 1.0 μm or more in the microstructure, the number percentage of inclusions having at least one of MnS, TiS, and (Mn, Ti)S precipitated to an oxide or oxysulfide composed of at least one of Ce and La, and at least one of O and S, or an oxide or oxysulfide composed of at least one of Ce and La, at least one of Si and Ti, and at least one of O and S may be 10% or more.

(11) In the high-strength steel sheet according to the above (1) or (2), the volume number density of elongated inclusions having an equivalent circle diameter of 1 μm or more, and an aspect ratio of 5 or more obtained by dividing the long diameter by the short diameter may be $1.0 \times 10^4$ inclusions/$mm^3$ or less in the steel structure.

(12) In the high-strength steel sheet according to the above (1) or (2), in the microstructure, the volume number density of inclusions having at least one of MnS, TiS, and (Mn, Ti)S precipitated to an oxide or oxysulfide composed of at least one of Ce and La, and at least one of O and S, or an oxide or oxysulfide composed of at least one of Ce and La, at least one of Si and Ti, and at least one of O and S may be $1.0 \times 10^3$ inclusions/$mm^3$ or more.

(13) In the high-strength steel sheet according to the above (1) or (2), elongated inclusions having an equivalent circle diameter of 1 μm or more, and an aspect ratio of 5 or more obtained by dividing the long diameter by the short diameter may be present in the microstructure, and the average equivalent circle diameter of the elongated inclusions may be 10 μm or less.

(14) In the high-strength steel sheet according to the above (1) or (2), inclusions having at least one of MnS, TiS, and (Mn, Ti)S precipitated to an oxide or oxysulfide composed of at least one of Ce and La, and at least one of O and S, or an oxide or oxysulfide composed of at least one of Ce and La, at least one of Si and Ti, and at least one of O and S may be present in the microstructure, and the inclusions may include a total of 0.5 mass % to 95 mass % of at least one of Ce and La in terms of an average composition.

(15) In the high-strength steel sheet according to the above (1) or (2), the average grain size in the microstructure may be 10 μm or less.

(16) In the high-strength steel sheet according to the above (1) or (2), the maximum hardness of martensite included in the microstructure may be 600 Hv or less.

(17) In the high-strength steel sheet according to the above (1) or (2), the sheet thickness may be 0.5 mm to 20 mm.

(18) The high-strength steel sheet according to the above (1) or (2) may further have a galvanized layer or a galvannealed layer on at least one surface.

(19) A method of manufacturing a high-strength steel sheet according to the aspect of the present invention includes a first process in which molten steel having the chemical components according to the above (1) or (2) is subjected to continuous casting so as to be processed into a slab; a second process in which hot rolling is carried out on the slab in a finishing temperature of 850° C. to 970° C., and a steel sheet is manufactured; and a third process in which the steel sheet is cooled to a cooling control temperature of 650° C. or lower at an average cooling rate of 10° C./second to 100° C./second, and then coiled at a coiling temperature of 300° C. to 650° C.

(20) In the method of manufacturing the high-strength steel sheet according to the above (19), in the third process, the cooling control temperature may be 450° C. or lower, the coiling temperature may be 300° C. to 450° C., and a hot-rolled steel sheet may be manufactured.

(21) The method of manufacturing the high-strength steel sheet according to the above (19) may further include, after the third process, a fourth process in which the steel sheet is pickled, and cold rolling is carried out on the steel sheet at a reduction in thickness of 40% or more; a fifth process in which the steel sheet is annealed at a maximum temperature of 750° C. to 900° C.; a sixth process in which the steel sheet is cooled to 450° C. or lower at an average cooling rate of 0.1° C./second to 200° C./second; and a seventh process in which the steel sheet is held in a temperature range of 300° C. to 450° C. for 1 second to 1000 seconds so as to manufacture a cold-rolled steel sheet.

(22) In the method of manufacturing the high-strength steel sheet according to the above (20), galvanizing or galvannealing may be carried out on at least one surface of the hot-rolled steel sheet.

(23) In the method of manufacturing the high-strength steel sheet according to the above (21), galvanizing or galvannealing may be carried out on at least one surface of the cold-rolled steel sheet.

(24) In the method of manufacturing the high-strength steel sheet according to the above (19), the slab may be reheated to 1100° C. or higher after the first process and before the second process.

Effects of the Invention

According to the present invention, it is possible to stably adjust the chemical composition of molten steel, suppress generation of coarse alumina inclusions, and precipitate sulfides in a slab through fine MnS-based inclusions by controlling Al deoxidation and deoxidation by addition of Ce and La. Since the fine MnS-based inclusions are dispersed in the steel sheet as fine spherical inclusions, do not deform during rolling, and do not easily serve as starting points of cracking, it is possible to obtain a high-strength steel sheet that is excellent in terms of hole expansion and ductility.

Since the high-strength steel sheet according to the above (1) is a multiphase steel sheet mainly including ferrite and martensite, the ductility is excellent. In addition, in the high-strength steel sheet according to the above (16), since the hardness of the martensite phase is controlled, it is possible to further enhance the effect of improving hole expansion by controlling the morphology of inclusions. Furthermore, in the method of manufacturing the high-strength steel sheet according to the above (19), it is possible to manufacture a multiphase steel sheet mainly including ferrite and martensite, in which fine MnS-based inclusions are dispersed, that is, a high-strength steel sheet that is excellent in terms of hole expansion and ductility.

DETAILED DESCRIPTION OF THE INVENTION

Figure 1:
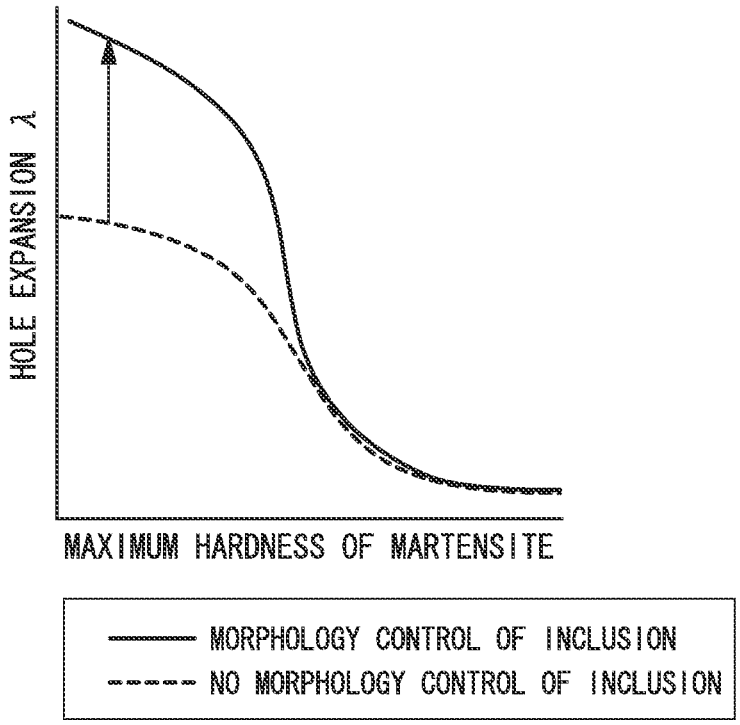
FIG. 1 is a view showing a relationship between the maximum hardness and the hole expansion of a martensite phase.

Hereinafter, the high-strength steel sheet of the present invention will be described in detail. Hereinafter, mass % in chemical components (chemical compositions) will be denoted simply by %.

Firstly, experiments that have been made until completion of the present invention will be described.

Deoxidation by various amounts (chemical components in molten steel) of Ce and La were carried out together with Al deoxidation so as to manufacture slabs. The slabs were hot-rolled so as to manufacture 3 mm hot-rolled steel sheets. Furthermore, the hot-rolled steel sheets were pickled, then cold-rolled at a reduction in thickness of 50%, and annealed under a variety of annealing conditions so as to manufacture cold-rolled steel sheets. The inventors provided the cold-rolled steel sheets for hole expansion tests and tension tests, and investigated the number densities, morphologies, and average chemical compositions of inclusions in the steel sheets.

As a result of the above tests, it was found that, in molten steel obtained by adding Si, then adding Al, then adding one or both of Ce and La, and thereby carrying out deoxidation, in a case in which ([Ce]+[La])/[acid-soluble Al] and ([Ce]+[La])/[S] are in predetermined ranges, the oxygen potential in the molten steel abruptly decreases, the concentration of $Al_2O_3$ being generated decreases, and a steel sheet that is excellent in terms of hole expansion can be obtained. Here, [Ce], [La], [acid-soluble Al], and [S] represent by mass % of Ce, La, acid-soluble Al, and S that are included in steel, respectively (hereinafter, the same expression as this description will be used).

The amount of increase in the hole expansion ratio of a cold-rolled steel sheet to which one or both of Ce and La were added with respect to the hole expansion ratio of a cold-rolled steel sheet to which neither Ce nor La were added was varied by the hardness of a martensite phase in the steel sheet, and the amount of increase increased as the hardness decreased.

It could be confirmed that, when the maximum hardness of the martensite phase was 600 Hv or less, the hole expansion were improved more clearly by adding one or both of Ce and La. The maximum hardness of the martensite phase refers to the maximum value of micro Vickers hardness obtained by randomly pressing an indenter with a load of 10 gf on a hard phase (other than a ferrite phase) 50 times.

The cold-rolled steel sheet to which neither Ce nor La were added (the steel sheet used to compare the hole expansion ratios) was annealed under the same conditions so as to have the same tensile strength as the cold-rolled steel sheet to which one or both of Ce and La were added. In this case, it was confirmed that uniform elongation of the cold-rolled steel sheet to which neither Ce nor La were added and uniform elongation of the cold-rolled steel sheet to which one or both of Ce and La were added were the same, and deterioration of the ductility due to the addition of Ce and La was not observed.

Meanwhile, in a microstructure that is substantially composed of bainite, the hole expansion were significantly improved by addition of Ce and La, but the ductility was small compared to the steel sheet mainly including ferrite and martensite.

Reasons why the hole expansion were improved by addition of Ce and La are considered to be as follows:

It is considered that, when Si is added to molten steel in manufacturing a slab, $SiO_2$ inclusions are formed, but the $SiO_2$ inclusions are reduced to Si by later addition of Al. Al reduces $SiO_2$ inclusions, and deoxidizes dissolved oxygen in the molten steel so as to form $Al_2O_3$-based inclusions. Some of $Al_2O_3$-based inclusions are removed though floatation, and the rest of the $Al_2O_3$-based inclusions remain in the molten steel.

After that, when Ce and La are added to the molten steel, a little amount of $Al_2O_3$ remains, but the $Al_2O_3$-based inclusions in the molten steel are reduced and decomposed, and fine and hard Ce oxides, La oxides, cerium oxysulfides, and lanthanum oxysulfides are formed by deoxidation using Ce and La.

When Al deoxidation is appropriately carried out based on the above deoxidation, similarly to a case in which Al deoxidation is rarely carried out, it is possible to precipitate MnS on the fine and hard Ce oxides, La oxides, cerium oxysulfides, and lanthanum oxysulfides which are formed by deoxidation by addition of Ce and La. As a result, it is possible to suppress deformation of the precipitated MnS during rolling, and therefore elongated coarse MnS in the steel sheet can be significantly reduced, and the hole expansion can be improved. Additionally, since it is also possible to further lower the oxygen potential of the molten steel by Al deoxidation, fluctuation in the chemical composition can be reduced.

Reasons why the degree of the hole expansion improved is varied by the hardness of the martensite phase in steel sheets having the same tensile strength and uniform elongation are considered to be as follows.

Hole expansion are significantly affected by the local ductility of a steel, and the most dominant factor in relation to hole expansion is considered to be the difference in hardness between microstructures (herein, between the martensite phase and the ferrite phase). Other powerful dominant factors in relation to hole expansion include the presence of nonmetallic inclusions, such as MnS, and many publications report that voids are formed from the inclusions as the starting points, grow, and link together such that the steel breaks.

Therefore, if the hardness of the martensite phase is excessively high, there are cases in which, even when the morphology of inclusions are controlled by addition of Ce and La, and occurrence of voids due to the inclusions is suppressed, stress concentrates at the interfaces between ferrite and martensite, voids are formed due to the difference in strength between the microstructures, and thereby the steel may break.

The inventors newly found that, if the cooling conditions after hot rolling in the case of a hot-rolled steel sheet and the annealing conditions in the case of a cold-rolled steel sheet are appropriately controlled, and the hardness of the martensite phase is reduced, it is possible to further enhance the effect of suppressing occurrence of voids by controlling the morphology of the inclusions. In addition, the inventors found that a steel sheet that is excellent in terms of ductility and hole expansion can be obtained by securing a predetermined amount or more of martensite in a microstructure mainly including ferrite and martensite, and controlling the morphology of inclusions by adding Ce and La.

Meanwhile, it is possible to add Ti to the molten steel after Al is added and before Ce and La are added. At this point in time, since oxygen in the molten steel is already deoxidized by Al, the amount of oxygen to be deoxidized by Ti is small. After that, due to Ce and La that have been added to the molten steel, $Al_2O_3$-based inclusions are reduced and decomposed, and fine Ce oxides, La oxides, cerium oxysulfides, and lanthanum oxysulfides are formed.

As described above, it is considered that, when complex deoxidation is carried out by adding Al, Si, Ti, Ce, and La, a small amount of $Al_2O_3$ remains, but fine and hard Ce oxides, La oxides, cerium oxysulfides, lanthanum oxysulfides, and Ti oxides are mainly formed.

During the complex deoxidation by addition of Al, Si, Ti, Ce, and La, if the Al deoxidation is appropriately carried out based on the deoxidation as described above, similarly to a case in which Al deoxidation is rarely carried out, it is possible to precipitate MnS, TiS, or (Mn, Ti)S on fine and hard oxides, such as Ce oxides, La oxides, and Ti oxides, or fine and hard oxysulfides, such as cerium oxysulfides and lanthanum oxysulfides. As a result, in a case in which a predetermined amount or more of Ti is added to the molten steel, the kinds of chemical elements included in inclusions slightly vary, but a mechanism that suppresses elongation of MnS-based inclusions was the same as in a case in which Ti is rarely added.

Based on the finding obtained from experimental studies, the inventors studied the chemical compositions, microstructures, and manufacturing conditions of steel sheets as described below. Firstly, a high-strength steel sheet according to an embodiment of the present invention will be described.

Hereinafter, reasons why the chemical compositions are limited in the high-strength steel sheet according to the embodiment of the present invention will be described.

C is the most fundamental element that controls the hardenability and strength of steel, which increases the hardness and thickness of a layer hardened by quenching so as to improve the fatigue strength. That is, C is an essential element for securing the strength of a steel sheet. In order to form retained austenite and low-temperature transformation phases that are necessary to obtain a desired high-strength steel sheet, the concentration of C needs to be 0.03% or more. When the concentration of C exceeds 0.30%, formability and weldability deteriorate. Therefore, in order to achieve a necessary strength and secure formability and weldability, the concentration of C needs to be 0.30% or less. When the balance between strength and formability is taken into account, the concentration of C is preferably 0.05% to 0.20%, and more preferably 0.10% to 0.15%.

Si is one major deoxidizing element. In addition, Si increases the number of nucleation sites of austenite during heating for quenching, and suppresses the grain growth of austenite so as to refine the grain size in a layer hardened by quenching. In addition, Si suppresses formation of carbides, and suppresses degradation of grain boundary strength due to carbides. Furthermore, Si is also effective for forming bainite, and plays a critical role from the viewpoint of securing the overall strength.

In order to develop the above effects, it is necessary to add 0.08% or more of Si to steel. When the concentration of Si is too high, even in a case in which Al deoxidation is sufficiently carried out, the concentration of $SiO_2$ in inclusions increases, and coarse inclusions become liable to be formed. In addition, in this case, toughness, ductility, and weldability deteriorate, and surface decarburization and surface flaws increase so as to deteriorate fatigue characteristics. Therefore, the upper limit of the concentration of Si needs to be 2.1%. When the balance between strength and other mechanical properties is taken into account, the concentration of Si is preferably 0.10% to 1.5%, and more preferably 0.12% to 1.0%.

Mn is a useful element for deoxidation in a steelmaking step, and an effective element for increasing the strength of the steel sheet together with C and Si. In order to obtain the above effect, the concentration of Mn needs to be 0.5% or more. When more than 4.0% of Mn is included in steel, ductility degrades due to segregation of Mn and enhancement of solid solution strengthening. In addition, since weldability and the toughness of a base metal deteriorate, the upper limit of the concentration of Mn is 4.0%. When the balance between strength and other mechanical properties is taken into account, the concentration of Mn is preferably 1.0% to 3.0%, and more preferably 1.2% to 2.5%.

P is useful in a case in which P is used as an element for substitutional solid solution strengthening which is smaller than an Fe atom. When the concentration of P in steel exceeds 0.05%, there are cases in which P segregates at the grain boundaries of austenite, the grain boundary strength degrades, and formability may deteriorate. Therefore, the upper limit of the concentration of P is 0.05%. When solid solution strengthening is not required, it is not necessary to add P to steel, and therefore the lower limit of the concentration of P includes 0%. Meanwhile, for example, the lower limit of the concentration of P may be 0.0001% in consideration of the concentration of P included as an impurity.

N is an element that is inevitably incorporated into steel since nitrogen in the air is trapped into molten steel during treating molten steel. N has an action of forming nitrides with chemical elements, such as Al and Ti, so as to promote refining of the microstructure in the base metal. However, when the concentration of N exceeds 0.01%, N forms coarse precipitates with chemical elements, such as Al and Ti, and hole expansion deteriorate. Therefore, the upper limit of the concentration of N is 0.01%. On the other hand, when the concentration of N is reduced to less than 0.0005%, the cost increases, and therefore the lower limit of the concentration of N may be 0.0005% from the viewpoint of industrial feasibility.

S is included in the steel sheet as an impurity, and liable to segregate in steel. Since S forms elongated coarse MnS-based inclusions so as to deteriorate hole expansion, the concentration is preferably extremely low. In the conventional techniques, it was necessary to significantly decrease the concentration of S in order to secure hole expansion.

However, when an attempt is made to decrease the concentration of S to less than 0.0001%, the desulfurization load during secondary refining increases, and the desulfurization cost increases excessively. In a case in which desulfurization during secondary refining is assumed, when the desulfurization cost in accordance with the quality of the steel sheet is taken into consideration, the lower limit of the concentration of S is 0.0001%. Meanwhile, in a case in which the costs for secondary refining are further suppressed, and the effect of addition of Ce and La are more effectively used, the concentration of S is preferably more than 0.0004%, more preferably 0.0005% or more, and most preferably 0.0010% or more.

In addition, in the present embodiment, MnS-based inclusions are precipitated on fine and hard inclusions, such as Ce oxides, La oxides, cerium oxysulfides, and lanthanum oxysulfides, so as to control the morphology of MnS-based inclusions. Therefore, inclusions do not easily deform during rolling, and elongation of the inclusions is prevented. Therefore, the upper limit of the concentration of S is specified by the relationship between the concentration of S and the total amount of one or both of Ce and La as described below. For example, the upper limit of the concentration of S is 0.1%.

In the embodiment, since the morphology of MnS-based inclusions are controlled by inclusions, such as Ce oxides, La oxides, cerium oxysulfides, and lanthanum oxysulfides, even when the concentration of S is high, it is possible to prevent S from adversely affecting the qualities of the steel sheet by adding one or both of Ce and La at an amount that corresponds to the concentration of S. That is, even when the concentration of S increases to a certain extent, a substantial desulfurization effect can be obtained by adding one or both of Ce and La to steel at an amount that corresponds to the concentration of S, and steel having the same qualities as extremely low sulfur steel can be obtained.

In other words, since the concentration of S is appropriately adjusted in accordance with the total amount of Ce and La, the flexibility is large for the upper limit of the concentration of S. As a result, in the embodiment, it is not necessary to carry out desulfurization of the molten steel during the secondary refining in order to obtain extremely low sulfur steel, and it is possible to skip the secondary refining. Therefore, it is possible to simplify the manufacturing processes of the steel sheet and, accordingly, reduce the costs for the desulfurization.

Generally, since oxides of Al are liable to form clusters so as to be coarse and deteriorate hole expansion, it is preferable to suppress acid-soluble Al in the molten steel as much as possible. However, the inventors newly found areas in which alumina-based oxides are prevented from forming clusters so as to be coarse by controlling the concentrations of Ce and La in the molten steel in accordance with the concentration of the acid-soluble Al while Al deoxidation is carried out. In the areas, of $Al_2O_3$-based inclusions formed by the Al deoxidation, some of the $Al_2O_3$-based inclusions are removed through floatation, and the rest of the $Al_2O_3$-based inclusions in the molten steel are reduced and decomposed by Ce and La that are to be added afterwards, thereby forming fine inclusions.

Therefore, in the embodiment, it is substantially unnecessary to add Al to steel, and, particularly, the flexibility is large for the concentration of the acid-soluble Al. For example, the concentration of the acid-soluble Al may be more than 0.004% in consideration of the relationship between the concentration of the acid-soluble Al and the total amount of one or both of Ce and La, which will be described below.

In addition, in order to jointly use Al deoxidation and deoxidation by the addition of Ce and La, the concentration of the acid-soluble Al may be more than 0.010%. In this case, unlike the conventional techniques, it becomes unnecessary to increase the amounts of Ce and La in order to secure the total amount of deoxidizing elements, the oxygen potential in steel can be further lowered, and variation in the amount of each chemical element in the chemical composition can be suppressed. Meanwhile, in a case in which the effect of jointly using Al deoxidation and deoxidation by the addition of Ce and La is further enhanced, the concentration of the acid-soluble Al is preferably more than 0.020%, and more preferably more than 0.040%.

The upper limit of the concentration of the acid-soluble Al is specified by the relationship between the acid-soluble Al and the total amount of one or both of Ce and La as described below. For example, the concentration of the acid-soluble Al may be 2.0% or less in consideration of the above relationship.

Here, the concentration of the acid-soluble Al is determined by measuring the concentration of Al that dissolves in an acid. For analysis of the acid-soluble Al, the fact that dissolved Al (or solute Al in a solid solution) dissolves in an acid, but $Al_2O_3$ does not dissolve in an acid is used. Here, examples of the acid include a mixed acid in which chloric acid, nitric acid, and water are mixed at a ratio (mass ratio) of 1:1:2. Using such an acid, Al that is soluble in the acid and $Al_2O_3$ that is insoluble in the acid are separated, and the concentration of the acid-soluble Al can be measured. Meanwhile, the acid-insoluble Al ($Al_2O_3$ that is insoluble in the acid) is determined as an inevitable impurity.

Ti is a major deoxidizing element, and increases the number of the nucleation sites of austenite when carbides, nitrides, and carbonitrides are formed, and the slabs are sufficiently heated before hot rolling. As a result, since the grain growth of austenite is suppressed, Ti contributes to refining of crystal grains and an increase in the strength of the steel sheet, promotes dynamic recrystallization during hot rolling, and significantly improves hole expansion.

Therefore, in a case in which the above effect is sufficiently enhanced, 0.008% or more of the acid-soluble Ti may be added to steel. In a case in which the above effect does not need to be sufficiently secured, and a case in which the slabs cannot be sufficiently heated, the concentration of the acid-soluble Ti may be less than 0.008%. Examples of imaginable situations in which the slabs cannot be sufficiently heated include a case in which the operation rate of the hot rolling is high and a case in which sufficient heating capacity is not provided in the hot rolling. Meanwhile, the lower limit of the concentration of the acid-soluble Ti in steel is not particularly limited, but may be, for example, 0.0001% since Ti is inevitably included in steel.

In addition, when the concentration of the acid-soluble Ti exceeds 0.2%, the deoxidation effect of Ti is saturated, coarse carbides, nitrides, and carbonitrides are formed by heating of the slabs before hot rolling, and the qualities of the steel sheet deteriorate. In this case, an effect in accordance with the addition of Ti cannot be obtained. Therefore, in the embodiment, the upper limit of the concentration of the acid-soluble Ti is 0.2%.

Therefore, the concentration of the acid-soluble Ti needs to be 0.0001% to 0.2%. In addition, in a case in which the effect of the carbides, nitrides, and carbonitrides of Ti is sufficiently secured, the concentration of the acid-soluble Ti is preferably 0.008% to 0.2%. In this case, in order to more reliably prevent the carbides, nitrides, and carbonitrides of Ti from coarsening, the concentration of the acid-soluble Ti may be 0.15% or less. On the other hand, in a case in which the effect of the carbides, nitrides, and carbonitrides of Ti and the deoxidation effect of Ti are not sufficiently secured, the concentration of the acid-soluble Ti is preferably more than or equal to 0.0001% and less than 0.008%.

When the slab is heated at a sufficient heating temperature before hot rolling, carbides, nitrides, and carbonitrides formed during casting can be made to temporarily dissolve so as to form solid solutions. Therefore, in order to obtain an effect in accordance with addition of Ti, the heating temperature before hot rolling is preferably higher than 1200° C. In this case, since fine carbides, nitrides, and carbonitrides precipitates again from solute Ti, it is possible to refine the crystal grains of the steel sheet and increase the strength of the steel sheet. On the other hand, the heating temperature before hot rolling exceeding 1250° C. is not preferred from the viewpoint of costs and scale forming. Therefore, the heating temperature before hot rolling is preferably 1250° C. or lower.

The concentration of the acid-soluble Ti is determined by measuring the concentration of Ti dissolved in an acid. For analysis of the acid-soluble Ti, the fact that dissolved Ti (or solute Ti in a solid solution) dissolves in an acid, but Ti oxides do not dissolve in an acid is used. Here, examples of the acid include a mixed acid in which chloric acid, nitric acid, and water are mixed at a ratio (mass ratio) of 1:1:2. Using such an acid, Ti that is soluble in the acid and Ti oxides that are insoluble in the acid are separated, and the concentration of the acid-soluble Ti can be measured. Meanwhile, the acid-insoluble Ti (Ti oxides that are insoluble in the acid) is determined as an inevitable impurity.

Ce and La are liable to reduce $Al_2O_3$ formed by Al deoxidation and $SiO_2$ formed by Si deoxidation, and serve as precipitation sites of MnS-based inclusions. Furthermore, Ce and La form inclusions (hard inclusions) including Ce oxides (for example, $Ce_2O_3$ and $CeO_2$), cerium oxysulfides (for example, $Ce_2O_2S$), La oxides (for example, $La_2O_3$ and $LaO_2$), lanthanum oxysulfides (for example, $La_2O_2S$), Ce oxide-La oxide, or cerium oxysulfide-lanthanum oxysulfide which are hard and fine, and do not easily deform during rolling, as a main compound (for example, the total amount of the compounds is 50% or more).

There are cases in which the hard inclusions include MnO, $SiO_2$, $TiO_2$, $Ti_2O_3$, or $Al_2O_3$ due to deoxidation conditions. However, when the main compound is the Ce oxides, cerium oxysulfides, La oxides, lanthanum oxysulfides, Ce oxide-La oxide, or cerium oxysulfide-lanthanum oxysulfide, the hard inclusions sufficiently serve as the precipitation sites of MnS-based inclusions while maintaining the size and hardness thereof.

The inventors experimentally found that the total concentration of one or both of Ce and La needs to be 0.001% to 0.04% in order to obtain the above inclusions.

When the total concentration of one or both of Ce and La is less than 0.001%, $Al_2O_3$ inclusions and $SiO_2$ inclusions cannot be reduced. In addition, when the total concentration of one or both of Ce and La exceeds 0.04%, large amounts of cerium oxysulfides and lanthanum oxysulfides are formed, and the oxysulfides coarsen such that hole expansion deteriorate. Therefore, the total of at least one selected from Ce and La is preferably 0.001% to 0.04%. In order to more reliably reduce $Al_2O_3$ inclusions and $SiO_2$ inclusions, the total concentration of one or both of Ce and La is most preferably 0.015% or more.

In addition, the inventors paid attention to the fact that the amount of MnS reformed by oxides or oxysulfides that includes one or both of Ce and La (hereinafter sometimes also referred to as "hard compounds") is expressed using the concentrations of Ce, La, and S, and obtained an idea that the concentration of S and the total concentration of Ce and La in steel are controlled using ([Ce]+[La])/[S].

Specifically, when ([Ce]+[La])/[S] is small, the amount of the hard compounds is small, and a large amount of MnS alone precipitates. When ([Ce]+[La])/[S] increases, the amount of the hard compounds becomes larger than that of MnS, and inclusions having a morphology in which MnS precipitates on the hard compounds increase. That is, MnS is reformed by the hard compounds. As a result, hole expansion are improved, and MnS is prevented from elongating.

That is, it is possible to use ([Ce]+[La])/[S] as a parameter that controls the morphology of MnS-based inclusions. Therefore, the inventors varied ([Ce]+[La])/[S] of the steel sheet, and evaluated the morphology of inclusions and hole expansion in order to clarify the composition ratio that is effective for suppressing the elongation of MnS-based inclusions. As a result, it was found that, when ([Ce]+[La])/[S] is 0.4 to 50, hole expansion are drastically improved.

When ([Ce]+[La])/[S] is less than 0.4, the number percentage of inclusions having a morphology in which MnS precipitates on the hard compounds significantly decreases, and the number percentage of MnS-based elongated inclusions that are liable to serve as starting points of cracking increases such that hole expansion degrade.

When ([Ce]+[La])/[S] exceeds 50, large amounts of formed cerium oxysulfides and lanthanum oxysulfides form coarse inclusions, and therefore hole expansion deteriorate. For example, when ([Ce]+[La])/[S] exceeds 70, cerium oxysulfides and lanthanum sulfides form coarse inclusions having an equivalent circle diameter of 50 μm or more.

In addition, when ([Ce]+[La])/[S] exceeds 50, the effect of controlling the morphology of MnS-based inclusions is saturated, and thereby the effect which is appropriate for the costs cannot be obtained. From the above results, ([Ce]+[La])/[5] needs to be 0.4 to 50. When the degree of controlling the morphology of MnS-based inclusions and the costs are taken into account, ([Ce]+[La])/[S] is preferably 0.7 to 30, and more preferably 1.0 to 10. Furthermore, in a case in which the morphology of MnS-based inclusion are most efficiently controlled while the chemical components in molten steel is adjusted, ([Ce]+[La])/[S] is most preferably 1.1 or more.

In addition, the inventors paid attention to the total concentration of one or both of Ce and La with respect to the concentration of the acid-soluble Al in the steel sheet of the embodiment, which is obtained from molten steel that has undergone deoxidation by Si, deoxidation by Al, and deoxidation by one or both of Ce and La, and obtained an idea of using ([Ce]+[La])/[acid-soluble Al] as a parameter that appropriately controls the oxygen potential in the molten steel.

The inventors experimentally found that, in a case in which ([Ce]+[La])/[acid-soluble Al] is 0.02 or more in the molten steel that has undergone deoxidation by Si, deoxidation by Al, and then deoxidation by at least one of Ce and La, it is possible to obtain a steel sheet that is excellent in terms of hole expansion. In this case, the oxygen potential in the molten steel abruptly decreases, and, consequently, the concentration of $Al_2O_3$ formed decreases. Therefore, even in a case in which deoxidation by Al is actively carried out, similarly to a case in which deoxidation by Al is rarely carried out, a steel sheet that is excellent in terms of hole expansion could be obtained. In addition, in a case in which ([Ce]+[La])/[acid-soluble Al] is less than 0.25, the costs for Ce or La decreases, and transfer of oxygen between chemical elements in the molten steel can also be efficiently controlled based on the affinity of each chemical element to oxygen. Meanwhile, in the embodiment, it is not necessary to actively carry out deoxidation by Al, and simply necessary to control the total concentration of at least one of Ca and La and the concentration of the acid-soluble Al so that ([Ce]+[La])/[acid-soluble Al] satisfies more than or equal to 0.02 and less than 0.25.

It was confirmed that, in a case in which ([Ce]+[La])/[acid-soluble Al] is less than 0.02, the amount of Al added to at least one of Ca and La becomes too large even when one or both of Ce and La are added to steel, and therefore coarse alumina clusters that deteriorate hole expansion are formed. In addition, in a case in which ([Ce]+[La])/[acid-soluble Al] is 0.25 or more, there are cases in which the morphology of inclusions are not sufficiently controlled. For example, cerium oxysulfides and lanthanum oxysulfides form coarse inclusions, and sufficient deoxidation is not carried out in the molten steel. Therefore, ([Ce]+[La])/[acid-soluble Al] needs to be more than or equal to 0.02 and less than 0.25. In addition, in order to further reduce the cost, and appropriately control the oxygen transfer between chemical elements in the molten steel, ([Ce]+[La])/[acid-soluble Al] is preferably less than 0.15, and more preferably less than 0.10. As such, even when desulfurization through the secondary refining is not carried out, a steel sheet that is excellent in terms of ductility and hole expansion can be obtained by controlling ([Ce]+[La])/[S] and ([Ce]+[La])/[acid-soluble Al].

Hereinafter, in the embodiment, reasons why the amount of each optional element in the chemical composition is limited will be described. The chemical elements are optional elements, and can be arbitrarily (optionally) added to steel. Therefore, the chemical elements may not be added to steel, and at least one selected from a group consisting of the chemical elements may be added to steel. Meanwhile, since there are cases in which the chemical elements are inevitably included in steel, the lower limit of the concentration of the chemical elements is a threshold value that determines inevitable impurities.

Nb, W, and V form carbides, nitrides, and carbonitrides with C or N, promotes refining of the microstructure in a base metal, and improves toughness.

In order to obtain complex carbides, complex nitrides, and the like, 0.01% or more of Nb may be added to steel. However, even when a large amount of Nb is added so that the concentration of Nb exceeds 0.20%, the effect of refining the microstructure in the base metal is saturated, and the manufacturing cost increases. Therefore, the upper limit of the concentration of Nb is 0.20%. In a case in which the cost of Nb is reduced, the concentration of Nb may be controlled to 0.10% or less. Meanwhile, the lower limit of the concentration of Nb is 0.001%.

In order to obtain the complex carbides, complex nitrides, and the like, W may be added to steel. However, even when a large amount of W is added so that the concentration of W exceeds 1.0%, the effect of refining the microstructure in the base metal is saturated, and the manufacturing cost increases. Therefore, the upper limit of the concentration of W is 1.0%. Meanwhile, the lower limit of the concentration of W is 0.001%.

In order to obtain complex carbides, complex nitrides, and the like, 0.01% or more of V may be added to steel. However, even when a large amount of V is added so that the concentration of V exceeds 1.0%, the effect of refining the microstructure in the base metal is saturated, and the manufacturing cost increases. Therefore, the upper limit of the concentration of V is 1.0%. In a case in which the cost of V is reduced, the concentration of V may be controlled to be 0.05% or less. Meanwhile, the lower limit of the concentration of V is 0.001%.

Cr, Mo, and B are chemical elements that improve the hardenability of steel.

Cr can be included in steel according to necessity in order to further secure the strength of the steel sheet. For example, in order to obtain the effect, 0.01% or more of Cr may be added to steel. When a large amount of Cr is included in steel, the balance between strength and ductility deteriorate. Therefore, the upper limit of the concentration of Cr is 2.0%. In a case in which the cost of Cr is reduced, the concentration of Cr may be controlled to be 0.6% or less. In addition, the lower limit of the concentration of Cr is 0.001%.

Mo can be included in steel according to necessity in order to further secure the strength of the steel sheet. For example, in order to obtain the effect, 0.01% or more of Mo may be added to steel. When a large amount of Mo is included in steel, it becomes difficult to suppress formation of pro-eutectic ferrite, and therefore the balance between strength and ductility deteriorate. Therefore, the upper limit of the concentration of Mo is 1.0%. In a case in which the costs of Mo are reduced, the concentration of Mo may be controlled to be 0.4% or less. In addition, the lower limit of the concentration of Mo is 0.001%.

B can be included in steel according to necessity in order to further strengthen grain boundaries and improve formability. For example, in order to obtain the effect, 0.0003% or more of B may be added to steel. Even when a large amount of B is included in steel, the effect is saturated, the cleanliness of steel is impaired, and the ductility deteriorates. Therefore, the upper limit of the concentration of B is 0.005%. In a case in which the cost of B is reduced, the concentration of B may be controlled to be 0.003% or less. In addition, the lower limit of the concentration of B is 0.0001%.

In order to strengthen grain boundaries and improve formability by controlling the morphology of sulfides, Ca, Mg, Zr, Sc, lanthanoids of Pr through Lu (Pr, Nd, Pm, Sm, Eu, Gd, Tb, Dy, Ho, Er, Tm, and Yb) can be included in steel according to necessity.

Ca controls the morphology of sulfides by the spheroidizing of sulfides or the like, so as to strengthen grain boundaries and improve the formability of the steel sheet. For example, in order to obtain the effect, the concentration of Ca may be 0.0001% or more. Even when a large amount of Ca is included in steel, the effect is saturated, the cleanliness of steel is impaired, and the ductility deteriorates. Therefore, the upper limit of the concentration of Ca is 0.01%. In a case in which the cost of Ca is reduced, the concentration of Ca may be controlled to be 0.004% or less. In addition, the lower limit of the concentration of Ca is 0.0001%.

Similarly, since Mg has almost the same effects as Ca, the concentration of Mg is from 0.0001% to 0.01%.

In order to spheroidize sulfides so as to improve the toughness of the base metal, 0.001% or more of Zr may be added to steel. When a large amount of Zr is included in steel, the cleanliness of steel is impaired, and the ductility deteriorates. Therefore, the upper limit of the concentration of Zr is 0.2%. In a case in which the cost of Zr is reduced, the concentration of Zr may be controlled to be 0.01% or less. In addition, the lower limit of the concentration of Zr is 0.0001%.

Similarly, in a case in which the morphology (shapes) of sulfides is controlled, the total concentration of at least one selected from Sc, and lanthanoids of Pr through Lu may be from 0.0001% to 0.1%.

In the embodiment, 0.001% to 2.0% of Cu and 0.001% to 2.0% of Ni can be included in steel according to necessity. The chemical elements improve hardenability so as to enhance the strength of steel. Meanwhile, in a case in which quenching is efficiently carried out using the chemical elements, the concentration of Cu may be 0.04% to 2.0%, and the concentration of Ni may be 0.02% to 1.0%.

Furthermore, in a case in which scraps or the like are used as some of starting materials, there are cases in which As, Co, Sn, Pb, Y, and Hf are inevitably incorporated. In order to prevent the chemical elements from adversely affecting the mechanical properties (for example, hole expansion) of the steel sheet, the concentration of each chemical elements is limited as below. The upper limit of the concentration of As is 0.5%. The upper limit of the concentration of Co is 1.0%. In addition, the upper limits of the concentrations of Sn, Pb, Y, and Hf are all 0.2%. Meanwhile, the lower limits of the chemical elements are all 0.0001%.

In the embodiment, the optional elements as described above can be optionally included in steel.

Next, the microstructure of the high-strength steel sheet according to the embodiment will be described.

Hole expansion are significantly affected by the local ductility of a steel, and the most dominant factor in relation to hole expansion is the difference in hardness between microstructures. Another powerful dominant factor in relation to hole expansion is the presence of nonmetallic inclusions, such as MnS. Generally, voids are caused from the inclusions as the starting point, grow and link together such that the steel breaks.

That is, when the hardness of the martensite phase is too large compared to the hardness of other microstructures (for example, the ferrite phase), there are cases in which, even when the morphology of inclusions are controlled by adding Ce and La, and occurrence of voids due to the inclusions is suppressed, stress concentrates at the interfaces between ferrite and martensite, voids are caused due to the difference in strength between the microstructures, and the steel may break.

When the cooling conditions after hot rolling in the case of a hot-rolled steel sheet, and the annealing conditions in the case of a cold-rolled steel sheet are appropriately controlled, and the hardness of the martensite phase is reduced, the effect of suppressing occurrence of voids by controlling the morphology of inclusions can be further enhanced. In this case, the effect of controlling the morphology of inclusions by Ce and La that are included in steel sheet is significantly exhibited as described above. FIG. 1 schematically shows a relationship between the maximum hardness (Vickers hardness) of martensite and hole expansion ratios (hole expansion) $\lambda$. As shown in FIG. 1, in a case in which the hardness of the martensite phase is suppressed to a certain value so that the morphology of inclusions are controlled using at least one of Ce and La, hole expansion can be significantly improved compared to a case in which the morphology of inclusions are not controlled. In addition, in a microstructure substantially composed of bainite, the degree of the hole expansion improved by the addition of Ce and La is large, but the ductility is poor compared to a steel sheet mainly including ferrite and martensite.

In the embodiment, a steel sheet that is excellent in terms of both hole expansion and ductility is provided. Therefore, the major microstructure is ferrite and martensite, and the microstructure includes 1% to 50% of the martensite phase in terms of the area ratio, optionally includes bainite and retained austenite, and has a remainder composed of a ferrite phase. In this case, in order to obtain uniform deformability, for example, bainite and retained austenite are controlled to 10% or less each. When the area ratio of the martensite phase is less than 1%, the work-hardenability is weak. In order to further enhance the work-hardenability, the area ratio of the martensite phase is preferably 3% or more, and more preferably 5% or more. On the other hand, when the area ratio of the martensite phase exceeds 50%, the uniform deformability of the steel sheet decreases significantly. In order to obtain a large uniform deformability, the area ratio of the martensite phase is preferably 30% or less, and more preferably 20% or less. Meanwhile, some or all of the martensite phase may be tempered martensite. The ratio of the martensite phase is determined by the area ratio of the martensite phase in a microstructure photograph obtained using an optical microscope. Herein, the inclusions as described below are included in the microstructures (the martensite phase, the ferrite phase, the bainite, and the retained austenite).

Since the hardness of the ferrite phase and the martensite phase included in steel varies with the chemical composition and manufacturing conditions (for example, the amount of strains caused during rolling or cooling rate) of steel, the hardness is not particularly limited. When it is taken into account that the hardness of the martensite phase is high compared to those of other microstructures, the maximum hardness of the martensite phase included in steel is preferably 600 Hv or less. The maximum hardness of the martensite phase is the maximum value of micro-Vickers hardness obtained by randomly pressing an indenter with a load of 10 gf on a hard phase (other than the ferrite phase) 50 times.

Next, the presence conditions of inclusions in the high-strength steel sheet of the embodiment will be described. Here, the steel sheet refers to a rolled sheet obtained after hot rolling or cold rolling.

In the embodiment, the presence conditions of inclusions in the steel sheet can be optionally specified from a variety of viewpoints.

In the first feature in relation to inclusions, the number density of inclusions that are present in the steel sheet and have an equivalent circle diameter of 0.5 μm to 2 μm is 15 inclusions/$mm^2$ or more.

In order to obtain a steel sheet that is excellent in terms of ductility and hole expansion, it is important to reduce as much as possible elongated coarse MnS-based inclusions that easily act as starting points of cracking or crack propagation paths.

As described above, the inventors found that, in a case in which ([Ce]+[La])/[acid-soluble Al] and ([Ce]+[La])/[S] are in the above ranges, since the oxygen potential in the molten steel abruptly lowers due to the complex deoxidations, and the concentration of $Al_2O_3$ in inclusions decreases, a steel sheet that is deoxidized by Si, then, deoxidized by Al, and then deoxidized by at least one of Ce and La is excellent in terms of ductility and hole expansion, similarly to a steel sheet manufactured with little deoxidation by Al.

In addition, the inventor also found that, since MnS precipitates on fine and hard Ce oxides, La oxides, cerium oxysulfides, and lanthanum oxysulfides that are formed due to deoxidation by the addition of Ce and La, and the precipitated MnS does not easily deform during rolling, the elongated coarse MnS is significantly reduced in the steel sheet.

That is, it was found that, in a case in which ([Ce]+[La])/[acid-soluble Al] and ([Ce]+[La])/[S] are in the above ranges, the number density of fine inclusions having an equivalent circle diameter of 2 μM or less abruptly increases, and the fine inclusions are dispersed in steel.

Since the fine inclusions do not easily aggregate, most of the inclusions have a spherical or spindle shape. In addition, since inclusions having MnS precipitated on Ce oxides, La oxides, cerium oxysulfides, and lanthanum oxysulfides have a high melting point and do not easily deform, the inclusions maintain an almost spherical shape even during hot rolling. As a result, the long diameter/short diameter (hereinafter sometimes referred to as the "elongation ratio") of most of the inclusions is generally 3 or less.

Since the likelihood of the inclusions to serve as starting points of fracture significantly varies with the shapes of the inclusions, the elongation ratio of the inclusions is preferably 2 or less.

Experimentally, attention was paid to the number density of inclusions having an equivalent circle diameter of 0.5 μm to 2 μm so that the inclusions can be easily identified through observation using a scanning electron microscope (SEM) or the like. With regard to the lower limit of the equivalent circle diameter, inclusions that are large enough to be sufficiently counted are used. That is, the number of inclusions was counted with respect to inclusions of 0.5 μm or more. The equivalent circle diameter is obtained by measuring the long diameter and the short diameter of an inclusion observed on a cross-section, and computing $(\text{long diameter} \times \text{short diameter})^{0.5}$.

While the detailed mechanism is not clear, it is considered that fine inclusions of 2 μm or less are dispersed in the microstructure at 15 inclusions/$mm^2$ or more due to a synergetic effect of the lowering of the oxygen potential in the molten steel by Al deoxidation and the refining of MnS-based inclusions. It is assumed that, due to the above, stress concentration caused during forming of hole expanding or the like is alleviated, and an effect of abruptly improving hole expansion is exhibited. As a result, it is considered that, during repetitive deformation or hole expanding, MnS-based inclusions are fine, and therefore MnS-based inclusions do not easily act as starting points of cracking or crack propagation paths, alleviate stress concentration, and improve formability, such as hole expansion. As such, with regard to the morphology of the inclusions, the number density of inclusions that are present in the steel sheet and have an equivalent circle diameter of 0.5 μm to 2 μm is preferably 15 inclusions/$mm^2$ or more.

In the second feature in relation to inclusions, of inclusions that are present in the steel sheet and have an equivalent circle diameter of 1 μm or more, the number percentage of elongated inclusions having an aspect ratio (elongation ratio) of 5 or more obtained by dividing the long diameter by the short diameter is 20% or less.

The inventors investigated whether or not elongated coarse MnS-based inclusions that easily act as starting points of cracking or crack propagation paths are reduced.

The inventor experimentally found that, when the equivalent circular diameters of the inclusions are less than 1 μm, even in a case in which MnS is elongated, the inclusions do not act as starting points of cracking, and ductility and hole expansion are not deteriorated. In addition, since inclusions having an equivalent circle diameter of 1 μm or more can be easily observed using a scanning electron microscope (SEM) or the like, the morphology and chemical compositions of inclusions having an equivalent circle diameter of 1 μm or more in the steel sheet were investigated, and the distribution of the elongated MnS was evaluated. The upper limit of the equivalent circle diameter of MnS is not particularly specified; however, for example, there are cases in which MnS of approximately 1 mm is observed in the steel sheet.

The number percentage of elongated inclusions is obtained in the following manner. Here, the elongated inclusion refers to an inclusion having a long diameter/short diameter (elongation ratio) of 5 or more.

The chemical compositions of a plurality (for example, a predetermined number of 50 or more) of inclusions having an equivalent circle diameter of 1 μm or more which are randomly selected using a SEM are analyzed, and the long diameter and short diameter of the inclusions are measured from a SEM image (secondary electron image). The number percentage of the elongated inclusions can be obtained by dividing the number of the detected elongated inclusions by the number of all inclusions investigated (in the above example, a predetermined number of 50 or more).

A reason why the elongated inclusions are defined as inclusions having an elongation ratio of 5 or more is that most of inclusions having an elongation ratio of 5 or more in the steel sheet to which Ce and La are not added are MnS. The upper limit of the elongation ratio of MnS is not particularly specified; however, for example, there are cases in which MnS having an elongation ratio of approximately 50 is observed in the steel sheet.

As a result of evaluation by the inventors, it was found that, in the steel sheets for which the number percentage of the elongated inclusions having an elongation ratio of 5 or more with respect to inclusions having an equivalent circle diameter of 1 μm or more is controlled to be 20% or less, the hole expansion are improved. When the number percentage of the elongated inclusions exceeds 20%, since a number of MnS-based elongated inclusions that easily act as starting points of cracking are present, the hole expansion degrades. In addition, as the grain sizes of the elongated inclusions increase, that is, as the equivalent circle diameters increase, stress concentration occurs more easily during forming and deformation, and therefore the elongated inclusions easily act as starting points of cracking or crack propagation paths, and the hole expansion abruptly deteriorates.

Therefore, in the embodiment, the number percentage of the elongated inclusions is preferably 20% or less. Since the hole expansion become better as the elongated MnS-based inclusions become smaller, the lower limit of the number percentage of the elongated inclusions include 0%.

In a case in which inclusions having an equivalent circle diameter of 1 μm or more are included, and elongated inclusions having an elongation ratio of 5 or more are not present in the inclusions, or in a case in which the equivalent circle diameters of inclusions are all less than 1 μm, the number percentage of elongated inclusions having an elongation ratio of 5 or more in inclusions having an equivalent circle diameter of 1 μm or more is determined to be 0%.

It is confirmed that the maximum equivalent circle diameters of elongated inclusions are also small compared to the average grain size of crystals (metallic crystals) in the microstructure, and the reduction of the maximum equivalent circle diameters of the elongated inclusions are also considered to be a factor that can drastically improve the hole expansion.

In the third feature in relation to inclusions, of inclusions having an equivalent circle diameter of 1.0 μm or more in the steel sheet, the number percentage of inclusions having at least one of MnS, TiS, and (Mn, Ti)S precipitated on an oxide or oxysulfide composed of at least one of Ce and La, and at least one of O and S, or an oxide or oxysulfide composed of at least one of Ce and La, at least one of Si and Ti, and at least one of O and S is 10% or more.

For example, in a steel sheet having ([Ce]+[La])/[S] of 0.4 to 50, MnS-based inclusions precipitate on an oxide or oxysulfide including one or both of Ce and La, or an oxide or oxysulfide including one or both of Ce and La, and one or both of Si and Ti (the above hard compounds). Meanwhile, in a steel sheet in which the acid-soluble Ti is less than 0.008%, there are many cases in which oxides or oxysulfides including one or both of Si and Ti are not formed.

The morphology of the inclusions is not particularly specified as long as MnS-based inclusions precipitate on the hard compounds, and there are many cases in which MnS-based inclusions precipitate around the hard compounds as nuclei.

Also, there are cases in which TiN precipitates together with MnS-based inclusions on the fine and hard Ce oxides, La oxides, cerium oxysulfides, and lanthanum oxysulfides. However, since TiN has little influence on ductility and hole expansion as described above, TiN itself is not included in MnS-based inclusions.

Since inclusions having MnS-based inclusions precipitated on the hard compounds in the steel sheet do not easily deform during rolling, the inclusions have a shape that is not elongated, that is, a spherical or spindle shape.

Here, inclusions that are determined to be not elongated (spherical inclusions) are not particularly specified; however, for example, the inclusions are an inclusion having an elongation ratio of 3 or less, and preferably an inclusion having an elongation ratio of 2 or less. This is because the elongation ratio of an inclusion having MnS-based inclusions precipitated on the hard compounds in a slab before rolling is 3 or less. In addition, when the spherical inclusion is a perfectly spherical body, the elongation ratio is 1, and therefore the lower limit of the elongation ratio is 1.

The inventors investigated the number percentage of the inclusions (spherical inclusions) by the same method as the method of measuring the number percentage of the elongated inclusions. That is, the chemical compositions of a plurality (for example, a predetermined number of 50 or more) of inclusions having an equivalent circle diameter of 1.0 μm or more which are randomly selected using a SEM are analyzed, and the long diameter and short diameter of the inclusions are measured from a SEM image (secondary electron image). The number percentage of the spherical inclusions can be obtained by dividing the number of the spherical inclusions having a detected elongation ratio of 3 or less by the number of all inclusions investigated (in the above example, a predetermined number of 50 or more). As a result, in the steel sheet for which the number percentage of inclusions having MnS-based inclusions precipitated on the hard compounds (spherical inclusions) is controlled to be 10% or more, the hole expansion are improved.

When the number percentage of the inclusions having MnS-based inclusions precipitated on the hard compounds is less than 10%, the number percentage of MnS-based elongated inclusions increases, and the hole expansion degrades. Therefore, in the embodiment, of the inclusions having an equivalent circle diameter of 1.0 μm or more, the number percentage of inclusions having MnS-based inclusions precipitated on the hard compounds is 10% or more.

Since the hole expansion are improved by precipitating a number of MnS-based inclusion on the hard compounds, the upper limit value of the number percentage of inclusions having MnS-based inclusions precipitated on the hard compounds includes 100%.

Meanwhile, since the inclusions having MnS-based inclusions precipitated on the hard compounds do not easily deform during rolling, the equivalent circle diameter is not particularly specified, and hole expansion are not adversely affected even when the equivalent circle diameter is 1 μm or more. However, when the equivalent circle diameter is too large, there is a possibility for inclusions to act as starting points of cracking, and therefore the upper limit of the equivalent circle diameter is preferably approximately 50 μm.

Additionally, in a case in which the equivalent circle diameters of inclusions are less than 1 μm, since the inclusions do not easily act as starting points of cracking, the lower limit of the equivalent circle diameter is not specified.

In the fourth feature in relation to inclusions, of inclusions that are present in the steel sheet and have an equivalent circle diameter of 1 μm or more, the volume number density of elongated inclusions having an aspect ratio of 5 or more obtained by dividing the long diameter by the short diameter (elongation ratio) is $1.0\times10^4$ inclusions/mm$^3$ or less.

The grain size distribution of inclusions is obtained through, for example, SEM observation of electrolyzed surfaces according to the SPEED method (Selective Potentiostatic Etching by Electrolytic Dissolution method). In the SEM observation of an electrolyzed surface by the SPEED method, a surface of a test specimen obtained from a steel sheet is polished, then, electrolyzed by the SPEED method, and the sample surface is directly observed using a SEM, whereby the sizes and number density of inclusions are evaluated.

The SPEED method is a method in which a metal matrix on the sample surface is electrolyzed using a solution of 10% acetyl acetone, 1% tetramethyl ammonium chloride, and methanol, and inclusions are shown. The electrolysis is performed, for example, in 1 coulomb per an area of the sample surface of 1 $cm^2$. A SEM image on the electrolyzed sample surface is processed by an image-processing, and the equivalent circle diameter and frequency (number) distribution of inclusions are obtained. The frequency distribution is divided by the depth of electrolysis so as to compute the number density of inclusions per volume.

The inventors evaluated the volume number density of elongated inclusions having an equivalent circle diameter of 1 μm or more and an elongation ratio of 5 or more as inclusions that act as starting points of cracking and deteriorate hole expansion. As a result, it was found that, when the volume number density of the elongated inclusion is $1.0\times10^4$ inclusions/$mm^3$ or less, hole expansion improves.

When the volume number density of the elongated inclusions exceeds $1.0\times10^4$ inclusions/$mm^3$, the number density of MnS-based elongated inclusions that easily act as starting points of cracking increases, and hole expansion degrade. Therefore, the volume number density of elongated inclusions having an equivalent circle diameter of 1 μm or more and an elongation ratio of 5 or more is limited to $1.0\times10^4$ inclusions/$mm^3$ or less. Since hole expansion improve as elongated MnS-based inclusions decrease, the lower limit value of the volume number density of the elongated inclusions includes 0%.

Meanwhile, similarly to the second feature in relation to inclusions, it is found that, in a case in which inclusions having an equivalent circle diameter of 1 μm or more and an elongation ratio of 5 or more are not present, or a case in which the equivalent circle diameters of inclusions are all less than 1 μm, of inclusions having an equivalent circle diameter of 1 μm or more, the volume number density of elongated inclusion having an elongation ratio of 5 or more is 0%.

In the fifth feature in relation to inclusions, of inclusions having an equivalent circle diameter of 1 μm or more in the steel sheet, the volume number density of inclusions having at least one of MnS, TiS, and (Mn, Ti)S precipitated on an oxide or oxysulfide (hard compound) composed of at least one of Ce and La, and at least one of O and S, or an oxide or oxysulfide composed of at least one of Ce and La, at least one of Si and Ti, and at least one of O and S is $1.0\times10^3$ inclusions/$mm^3$ or more.

Investigation by the inventors showed that unelongated MnS-based inclusions had MnS-based inclusions precipitated on the hard compounds and had an almost spherical or spindle shape.

The morphology of the inclusions are not particularly specified as long as MnS-based inclusions are precipitated on the hard compounds, but there are many cases in which MnS-based inclusions precipitate around the hard compounds as nuclei.

The spherical inclusion is defined in the same manner as in the third feature in relation to inclusions, and, the volume number density of the spherical inclusions is measured using the same SPEED method as in the fourth feature in relation to inclusions.

As a result of investigation by the inventor on the volume number density of the spherical inclusions, it was found that in steel sheets for which the volume number density of inclusions having MnS-based inclusions precipitated around the hard compounds as nuclei (spherical inclusions) is controlled to be $1.0\times10^3$ inclusions/$mm^3$ or more, hole expansion improves.

When the volume number density of inclusions having MnS-based inclusions precipitated on the hard compounds becomes less than $1.0\times10^3$ inclusions/$mm^3$, the number percentage of MnS-based elongated inclusions increases, and hole expansion degrades. Therefore, the volume number density of inclusion having MnS-based inclusion precipitated on the hard compounds is $1.0\times10^3$ inclusions/$mm^3$ or more. Since hole expansion are improved by precipitating a number of MnS-based inclusions using the hard compounds as nuclei, the upper limit of the volume number density is not specified.

The equivalent circle diameters of inclusions having MnS-based inclusions precipitated on the hard compounds are not particularly specified. However, when the equivalent circle diameter is too large, there is a possibility for inclusions to act as starting points of cracking, and therefore the upper limit of the equivalent circle diameter is preferably approximately 50 μm.

Additionally, in a case in which the equivalent circle diameters of inclusions are less than 1 μm, no problem occurs, and therefore the lower limit of the equivalent circle diameter is not specified.

In the sixth feature in relation to inclusions, of inclusions that are present in the steel sheet and have an equivalent circle diameter of 1 μm or more, the average equivalent circle diameter of inclusions having an aspect ratio of 5 or more obtained by dividing the long diameter by the short diameter (elongation ratio) is 10 μm or less.

The inventors evaluated the average equivalent circle diameter of elongated inclusions having an equivalent circle diameter of 1 μm or more and a elongation ratio of 5 or more as inclusions that act as starting points of cracking and deteriorate hole expansion. As a result, it was found that, when the average equivalent circle diameter of the elongated inclusions is 10 μm or less, hole expansion improves. This is assumed to be because, as the amount of Mn or S in the molten steel increases, the number of MnS-based inclusions being formed increases, and the sizes of MnS-based inclusions being formed also increase.

As a result, attention was paid to a phenomenon in which the average equivalent circle diameter of the elongated inclusions increases as the number percentage of the elongated inclusions increases, and the average equivalent circle diameter of the elongated inclusions was specified as a parameter.

When the average equivalent circle diameter of the elongated inclusions exceeds 10 μm, the number percentage of coarse MnS-based inclusions that easily act as starting points of cracking increases. As a result, hole expansion degrades, and therefore the morphology of inclusions is controlled so that the average equivalent circle diameter of the elongated inclusions having equivalent circle diameter of 1 μm or more and an elongation ratio of 5 or more becomes 10 μm or less.

Since the average equivalent circle diameter of the elongated inclusions is obtained by measuring the equivalent circle diameters of inclusions that are present in the steel sheet and have an equivalent circle diameter of 1 μm or more using a SEM, and dividing the total of equivalent circle diameters of a plurality (for example, a predetermined number of 50 or more) of inclusions by the number of the plurality of inclusions, the lower limit of the average equivalent circle diameter is 1 μm.

In the seventh feature in relation to inclusion, inclusions having at least one of MnS, TiS, and (Mn, Ti)S precipitated on an oxide or oxysulfide composed of at least one of Ce and La, and at least one of O and S, or an oxide or oxysulfide composed of at least one of Ce and La, at least one of Si and Ti, and at least one of O and S are present in the steel sheet, and the inclusions include a total of 0.5 mass % to 95 mass % of at least one of Ce and La in terms of an average chemical composition.

As described above, in order to improve hole expansion, it is important to precipitate MnS-based inclusions on the hard compounds and prevent elongation of MnS-based inclusions.

With regard to the morphology of the inclusions, MnS-based inclusions may be precipitated on hard inclusions, and, generally, MnS-based inclusions precipitate around hard inclusions as nuclei.

The inventors analyzed the chemical compositions of inclusions having MnS-based inclusions precipitated on the hard inclusions through SEM and energy dispersive X-ray spectroscopy (EDX) in order to clarify the chemical compositions of inclusions, which are effective for suppressing elongation of MnS-based inclusions. When the equivalent circle diameters of the inclusions are 1 μm or more, since inclusions are easily observed, the composition analysis was carried out on inclusions having an equivalent circle diameter of 1 μm or more. In addition, since inclusions having MnS-based inclusions precipitated on hard inclusions are not elongated as described above, the elongation ratios are all 3 or less. Therefore, the composition analysis was carried out on spherical inclusions having an equivalent circle diameter of 1 μm or more and an elongation ratio of 3 or less, which are defined in the third feature in terms of inclusions.

As a result, it was found that, when the spherical inclusions include a total of 0.5% to 95% of one or both of Ce and La in terms of an average chemical composition, hole expansion improves.

When the average amount of the sum of one or both of Ce and La in the spherical inclusions is less than 0.5 mass %, the number percentage of inclusions having MnS-based inclusions precipitated on the hard compounds significantly decreases, and therefore the number percentage of MnS-based elongated inclusions that easily act as starting points of cracking increases, and hole expansion and fatigue characteristics degrade. Meanwhile, the larger the average amount of the sum of one or both of Ce and La, the more preferable. For example, the upper limit of the average amount may be 95% or 50% according to the amount of MnS-based inclusions.

When the average amount of the sum of one or both of Ce and La in the spherical inclusions exceeds 95%, large amounts of cerium oxysulfides and lanthanum oxysulfides form coarse inclusions having an equivalent circle diameter of 50 μm or more, hole expansion and fatigue characteristics deteriorate.

Meanwhile, the high-strength steel sheet of the embodiment may be a cold-rolled steel sheet or a hot-rolled steel sheet. In addition, the high-strength steel sheet of the embodiment may be a coated steel sheet having a coating, such as a galvanized layer or a galvannealed layer, on at least one surface thereof.

Next, the manufacturing conditions of the high-strength steel sheet according to an embodiment of the present invention will be described. Meanwhile, the chemical composition of the molten steel is the same as the chemical composition of the high-strength steel sheet of the above embodiment.

In the present invention, an alloy of C, Si, Mn, and the like is added to molten steel that has been blown and decarburized in a converter, and stirred so as to carry out deoxidization and adjust the chemical components. Meanwhile, according to necessity, deoxidization can be carried out using a vacuum degassing apparatus.

Meanwhile, with regard to S, since desulfurization need not be carried out in the refining process as described above, a desulfurization process can be skipped. However, in a case in which desulfurization of the molten steel is required in secondary refining in order to melt extremely low sulfur steel having a concentration of S of 20 ppm or less, the amount of the chemical components may be controlled by carrying out desulfurization.

Deoxidation and composition control are carried out in the following manner.

After Si (for example, Si or a compound including Si) is added to the molten steel, and approximately three minutes pass, Al (for example, Al or a compound including Al) is added to the molten steel, and deoxidization is carried out. A floatation time of approximately 3 minutes is preferably secured in order to make oxygen and Al combine together so as to float $Al_2O_3$. After that, in a case in which addition of Ti (for example, Ti or a compound including Ti) is required, Ti is added to the molten steel. In this case, a floatation time of approximately 2 to 3 minutes is preferably secured in order to make oxygen and Ti combine together so as to float $TiO_2$ and $Ti_2O_3$.

After that, the chemical composition are controlled by adding one or both of Ce and La to the molten steel so as to satisfy $0.02 \leq ([Ce]+[La])/[\text{acid-soluble Al}] < 0.25$, and $0.4 \leq ([Ce]+[La])/[S] \leq 50$.

In a case in which optional elements are added, addition of the optional elements is completed before one or both of Ce and La are added to the molten steel. In this case, the molten steel is sufficiently stirred so as to adjust the amounts of the optional elements, and then one or both of Ce and La are added to the molten steel. The molten steel manufactured in the above manner is subjected to continuous casting so as to manufacture slabs.

With regard to the continuous casting, the embodiment can be sufficiently applied not only to ordinary slab continuous casting in which approximately 250 mm-thick slabs are manufactured but also to, for example, thin slab continuous casting in which 150 mm or less-thick slabs are manufactured.

In the embodiment, the high-strength hot-rolled steel sheet can be manufactured in the following manner.

The obtained slab is reheated to 1100° C. or higher, and preferably 1150° C. or higher according to necessity. Particularly, in a case in which it is necessary to sufficiently control the morphology (for example, fine precipitation) of carbides and nitrides, it is necessary to temporarily form solid solutions by dissolving carbides and nitrides in steel, and therefore the heating temperature of the slab before hot rolling preferably exceeds 1200° C. A ferrite phase whose ductility is improved in a cooling process after rolling can be obtained by forming solid solutions by dissolving carbides and nitrides in steel.

When the heating temperature of the slab before hot rolling exceeds 1250° C., there are cases in which the surfaces of the slab are significantly oxidized. Particularly, there are cases in which wedge-shaped surface defects caused by selective oxidation of grain boundaries are liable to remain after descaling, and the qualities of the surfaces after rolling are impaired. Therefore, the upper limit of the heating temperature is preferably 1250° C. Meanwhile, the heating temperature is preferably as low as possible in terms of costs.

Next, hot rolling is carried out at a finishing temperature of 850° C. to 970° C. on the slab so as to manufacture a steel sheet. When the finishing temperature is lower than 850° C., the rolling is carried out in a two-phase region, and therefore ductility degrades. When the finishing temperature exceeds 970° C., austenite grain sizes become coarse, the ratio of the ferrite phase decreases, and ductility degrades.

After the hot rolling, the steel sheet is cooled to a temperature range of 450° C. or lower (cooling control temperature) at an average cooling rate of 10° C./second to 100° C./second, the steel sheet is coiled in a temperature of 300° C. to 450° C. (coiling temperature). A hot-rolled steel sheet is manufactured as a final product in the above manner. In a case in which the cooling control temperature after hot rolling is higher than 450° C., a ratio of desired martensite phase cannot be obtained, and therefore the upper limit of the coiling temperature is 450° C. Meanwhile, in a case in which the martensite phase is secured more flexibly, the upper limits of the cooling control temperature and the coiling temperature are preferably 440° C. When the coiling temperature is 300° C. or lower, the hardness of the martensite phase excessively increases, and therefore the lower limit of the coiling temperature is 300° C.

In addition, when the cooling rate is less than 10° C./second, pearlite is liable to be formed, and, when the cooling rate exceeds 100° C./second, it is difficult to control the coiling temperature.

When a hot-rolled steel sheet is manufactured by controlling the hot rolling conditions and the cooling conditions after hot rolling in the above manner, a high-strength steel sheet that is excellent in terms of hole expansion and ductility, and mainly includes ferrite and martensite can be manufactured.

In addition, in the embodiment, the high-strength cold-rolled steel sheet can be manufactured in the following manner.

After the casting, the slab having the above chemical composition is reheated to 1100° C. or higher according to necessity. Meanwhile, reasons why the temperature of the slab before the hot rolling is controlled are the same as in a case in which the above high-strength hot-rolled steel sheet is manufactured.

Next, hot rolling is carried out at a finishing temperature of 850° C. to 970° C. on the slab so as to manufacture a steel sheet. Furthermore, the steel sheet is cooled to a temperature range of 300° C. to 650° C. (cooling control temperature) at an average cooling rate of 10° C./second to 100° C./second. After that, the steel sheet is coiled at a temperature of 300° C. to 650° C. (coiling temperature) so as to manufacture a hot-rolled steel sheet as an intermediate material.

When the cooling control temperature and the coiling temperature are higher than 650° C., lamellar pearlite is liable to be formed, and the lamellar pearlite cannot be sufficiently melt through annealing, and therefore hole expansion degrades. In addition, when the coiling temperature is lower than 300° C., the hardness of the martensite phase excessively increases, and therefore it is difficult to efficiently coil the steel sheet. Meanwhile, reasons why the cooling rate and the finishing temperature of the hot rolling are limited are the same as in a case in which the above high-strength hot-rolled steel sheet is manufactured.

The hot-rolled steel sheet (steel sheet) manufactured in the above manner is pickled, then, subjected to cold rolling at a reduction in thickness of 40% or more, and annealed at a maximum temperature of 750° C. to 900° C. After that, the steel sheet is cooled to 450° C. or lower at an average cooling rate of 0.1° C./second to 200° C./second, and, subsequently, held for 1 second to 1000 seconds in a temperature range of 300° C. to 450° C. A high-strength cold-rolled steel sheet that is excellent in terms of elongation and hole expansion can be manufactured as a final product in the above manner.

In manufacturing the cold-rolled steel sheet, when the reduction in thickness is less than 40%, it is not possible to sufficiently refine crystal grains after the annealing.

In a case in which the maximum temperature of the annealing is lower than 750° C., the amount of austenite obtained through the annealing is small, and therefore it is not possible to form a desired amount of martensite in the steel sheet. When the annealing temperature increases, the grain sizes of the austenite becomes coarse, ductility degrades, and manufacturing cost increases, and therefore the upper limit of the maximum temperature of the annealing is 900° C.

The cooling after the annealing is important to promote transformation from austenite to ferrite and martensite. When the cooling rate is less than 0.1° C./second, since pearlite is formed such that hole expansion and strength degrade, the lower limit of the cooling rate is 0.1° C./second. In a case in which the cooling rate exceeds 200° C./second, it is not possible to sufficiently proceed with ferrite transformation, and ductility degrades, and therefore the upper limit of the cooling rate is 200° C./second.

The cooling temperature during the cooling after the annealing is 450° C. or lower. When the cooling temperature exceeds 450° C., it is difficult to form martensite. Next, the cooled steel sheet is held in a temperature range of 300° C. to 450° C. for 1 second to 1000 seconds.

A reason why the lower limit of the cooling temperature cannot be provided is that martensite transformation can be promoted by once cooling the steel sheet to a temperature lower than the holding temperature. Meanwhile, even when the cooling temperature is 300° C. or lower, as long as the steel sheet is held in a temperature higher than the cooling temperature, the martensite is tempered, and it is possible to reduce the difference in hardness between the martensite and the ferrite.

When the holding temperature is lower than 300° C., the hardness of the martensite phase excessively increases. In addition, when the holding time is less than 1 second, thermal shrinkage-induced residual strains remain, and elongation degrades. When the holding time exceeds 1000 seconds, more bainite and the like are formed than is necessary, and a desired amount of martensite cannot be formed.

As described above, when a hot-rolled steel sheet is manufactured by controlling the hot rolling conditions and the cooling conditions after the hot rolling, and a cold-rolled steel sheet is manufactured from the hot-rolled steel sheet by controlling the cold rolling conditions, the annealing conditions, the cooling conditions, and the holding conditions, it is possible to manufacture a high-strength cold-rolled steel sheet that is excellent in terms of hole expansion and ductility, and mainly includes ferrite and martensite.

Therefore, in the embodiment, molten steel is processed into a slab, hot rolling is carried out on the slab at a finishing temperature of 850° C. to 970° C. so as to manufacture a steel sheet. After that, the steel sheet is cooled to a cooling control temperature of 650° C. or lower at an average cooling rate of 10° C./second to 100° C./second, and then coiled at a coiling temperature of 300° C. to 650° C. Here, in a case in which a hot-rolled steel sheet is manufactured, the cooling control temperature is 450° C. or lower, and the coiling temperature is 300° C. to 450° C. In addition, when a cold-rolled steel sheet is manufactured, the coiled steel sheet is pickled, cold rolling is carried out on the steel sheet at a reduction in thickness of 40% or more, the cold-rolled steel sheet is annealed at a maximum temperature of 750° C. to 900° C., cooled to 450° C. or lower at an average cooling rate of 0.1° C./second to 200° C./second, and held in a temperature range of 300° C. to 450° C. for 1 second to 1000 seconds.

Figure 2:
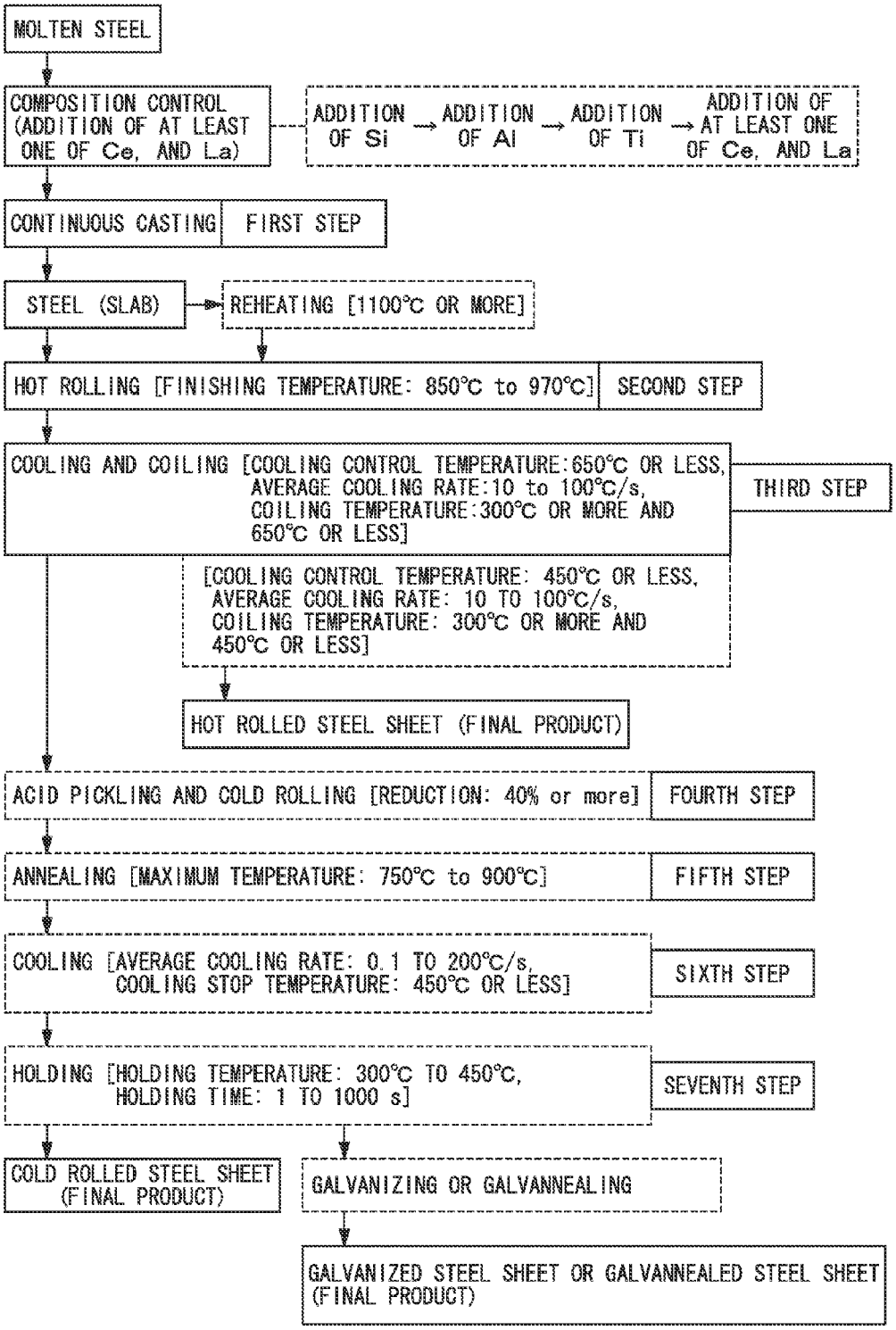
FIG. 2 is a flowchart showing a method of manufacturing a high-strength steel sheet according to an embodiment of the present invention.

Meanwhile, a flowchart of the method of manufacturing the high-strength steel sheet of the embodiment is shown in FIG. 2 for easy of understanding. Meanwhile, the broken lines in the flowchart indicate processes or manufacturing conditions that are selected according to necessity.

Furthermore, coating may be appropriately carried out on at least one surface of the hot-rolled steel sheet and the cold-rolled steel sheet. For example, zinc-based coating such as coating using galvanizing and galvannealing can be formed as a coating. The zinc-based coating can also be formed through electroplating or hot dipping. The galvannealing coating can be obtained by, for example, alloying a zinc coating (galvanizing coating) that is formed through electroplating or hot dipping in a predetermined temperature (for example, a temperature of 450° C. to 600° C., and a time of 10 seconds to 90 seconds). A galvanizing steel sheet and a galvannealed steel sheet can be manufactured as final products in the above manner.

Additionally, a variety of organic films and coatings can be formed on the hot-rolled steel sheet, the cold-rolled steel sheet, the galvanized steel sheet, and the galvannealed steel sheet.

EXAMPLES

Hereinafter, examples of the present invention will be described.

Steels that had been prepared and melted in a converter and had the chemical components as shown in Tables 1 to 3 were cast so as to produce slabs. The steels having each chemical component were heated to a temperature of 1150° C. or higher in a heating furnace, subjected to hot rolling at a finishing temperature of 850° C. to 920° C., cooled at an average cooling rate of 30° C./second, and coiled in a coiling temperature of 100° C. to 600° C., thereby producing 2.8 mm to 3.2 mm-thick hot-rolled steel sheets. The manufacturing conditions and mechanical properties of the hot-rolled steel sheets are shown in Tables 4 to 6, and the microstructures of the hot-rolled steel sheets are shown in Tables 7 to 9.

TABLE I

| Steel No. | Chemical components (mass %) | | | | | | | | | | | |
|---|---|---|---|---|---|---|---|---|---|---|---|---|
| | C | Si | Mn | P | S | N | Acid-soluble Al | Acid-soluble Ti | Cr | Nb | V | Mo |
| A1 | 0.067 | 0.48 | 1.9 | 0.015 | 0.0049 | 0.0033 | 0.024 | — | — | — | — | — |
| A2 | 0.135 | 0.52 | 2.1 | 0.015 | 0.0030 | 0.0044 | 0.042 | — | — | — | — | — |
| A3 | 0.068 | 0.60 | 2.5 | 0.020 | 0.0049 | 0.0037 | 0.034 | — | — | — | — | — |
| A4 | 0.157 | 0.41 | 2.4 | 0.016 | 0.0029 | 0.0044 | 0.036 | — | — | — | — | — |
| A5 | 0.153 | 1.15 | 2.2 | 0.008 | 0.0029 | 0.0006 | 0.030 | 0.006 | 0.5 | 0.01 | — | — |
| A6 | 0.135 | 0.58 | 2.4 | 0.012 | 0.0038 | 0.0026 | 0.041 | — | 0.4 | — | — | 0.10 |
| a1 | 0.070 | 0.52 | 1.9 | 0.015 | 0.0048 | 0.0036 | 0.026 | — | — | — | — | — |
| a2 | 0.155 | 1.02 | 2.1 | 0.008 | 0.0031 | 0.0005 | 0.031 | 0.006 | 0.5 | 0.01 | — | — |
| a3 | 0.072 | 0.62 | 2.4 | 0.020 | 0.0052 | 0.0035 | 0.034 | — | — | — | — | — |
| a4 | 0.081 | 0.71 | 1.8 | 0.015 | 0.0015 | 0.0037 | 0.024 | — | — | — | — | — |
| a5 | 0.083 | 0.62 | 2.3 | 0.016 | 0.0013 | 0.0026 | 0.003 | 0.005 | — | 0.03 | — | 0.15 |
| a6 | 0.067 | 0.50 | 2.0 | 0.015 | 0.0029 | 0.0034 | 0.035 | 0.250 | — | 0.15 | — | — |
| a7 | 0.153 | 0.98 | 2.2 | 0.008 | 0.0029 | 0.0006 | 0.030 | 0.006 | 5.3 | 0.01 | — | — |

| Steel No. | Chemical components (mass %) | | | | | | | ([Ce] + [La]/) [Acid-soluble Al] | ([Ce] + [La])/ [S] |
|---|---|---|---|---|---|---|---|---|---|
| | Zr | B | Ca | Cu | Ni | Ce | La | | |
| A1 | — | — | — | — | — | 0.0040 | — | 0.17 | 0.8 |
| A2 | — | — | 0.001 | — | — | — | 0.0050 | 0.12 | 1.7 |
| A3 | — | — | — | — | — | — | 0.0040 | 0.12 | 0.8 |
| A4 | — | — | — | 0.1 | — | — | 0.0050 | 0.14 | 1.7 |
| A5 | — | 0.001 | — | — | — | 0.0050 | — | 0.17 | 1.7 |
| A6 | 0.005 | — | — | — | 0.05 | — | 0.0060 | 0.15 | 1.6 |
| a1 | — | — | — | — | — | — | 0.0010 | 0.04 | 0.2 |
| a2 | — | 0.001 | — | — | — | — | — | — | — |
| a3 | — | — | — | — | — | — | — | — | — |
| a4 | — | — | — | — | — | 0.0400 | 0.0400 | 3.32 | 53.3 |
| a5 | — | 0.002 | — | — | — | 0.0300 | 0.0450 | 1.53 | 54.2 |
| a6 | — | — | — | — | — | 0.0020 | 0.0010 | 0.08 | 1.0 |
| a7 | — | 0.001 | — | — | — | 0.0050 | — | 0.17 | 1.7 |

* "—" indicates that the corresponding chemical element is not added.

*The underlines in this Table indicate that the corresponding amount does not satisfy the conditions of the chemical components according to the present invention.

TABLE 2

| Steel No. | Chemical components (mass %) | | | | | | | | | | |
|---|---|---|---|---|---|---|---|---|---|---|---|
| | C | Si | Mn | P | S | N | Acid-soluble Al | Acid-soluble Ti | Cr | Nb | V |
| B1 | 0.07 | 0.42 | 1.9 | 0.014 | 0.0015 | 0.0034 | 0.025 | 0.02 | — | — | — |
| B2 | 0.07 | 0.50 | 2.1 | 0.015 | 0.0030 | 0.0036 | 0.034 | 0.05 | — | — | — |
| B3 | 0.14 | 0.49 | 2.0 | 0.015 | 0.0031 | 0.0047 | 0.041 | 0.02 | — | — | — |

TABLE 2-continued

| | | | | | | | | | | | |
|---|---|---|---|---|---|---|---|---|---|---|---|
| B4 | 0.07 | 0.58 | 2.5 | 0.020 | 0.0051 | 0.0034 | 0.035 | 0.10 | — | — | — |
| B5 | 0.08 | 0.59 | 2.3 | 0.015 | 0.0049 | 0.0033 | 0.042 | 0.02 | — | — | — |
| B6 | 0.15 | 0.49 | 2.6 | 0.009 | 0.0010 | 0.0045 | 0.036 | 0.01 | — | — | — |
| B7 | 0.16 | 2.07 | 2.0 | 0.010 | 0.0024 | 0.0022 | 0.031 | 0.02 | — | 0.02 | — |
| B8 | 0.15 | 1.03 | 2.0 | 0.008 | 0.0030 | 0.0006 | 0.031 | 0.01 | 0.5 | 0.01 | — |
| B9 | 0.15 | 0.61 | 2.8 | 0.012 | 0.0042 | 0.0023 | 0.042 | 0.01 | 0.4 | — | — |
| b1 | 0.07 | 0.49 | 2.0 | 0.016 | 0.0029 | 0.0034 | 0.036 | 0.05 | — | — | — |
| b2 | 0.13 | 0.52 | 2.2 | 0.015 | 0.0030 | 0.0046 | 0.040 | 0.02 | — | — | — |
| b3 | 0.08 | 0.59 | 2.3 | 0.015 | 0.0048 | 0.0037 | 0.039 | 0.02 | — | — | — |
| b4 | 0.08 | 0.59 | 2.1 | 0.015 | 0.0029 | 0.0024 | 0.030 | 0.05 | — | 0.03 | — |
| b5 | 0.15 | 1.97 | 1.9 | 0.010 | 0.0026 | 0.0018 | 0.030 | 0.02 | — | 0.02 | — |
| b6 | 0.14 | 0.59 | 2.7 | 0.011 | 0.0038 | 0.0027 | 0.041 | 0.01 | 0.4 | — | — |
| b7 | 0.07 | 0.38 | 1.8 | 0.015 | 0.0015 | 0.0037 | 0.025 | 0.02 | — | — | — |
| b8 | 0.16 | 0.49 | 2.5 | 0.009 | 0.0010 | 0.0046 | 0.035 | 0.01 | — | — | — |
| b9 | 0.35 | 0.62 | 3.6 | 0.012 | 0.0039 | 0.0025 | 0.041 | — | 0.4 | — | — |
| b10 | 0.07 | 0.50 | 2.0 | 0.015 | 0.0029 | 0.0034 | 0.035 | 0.25 | — | 0.15 | — |
| b11 | 0.15 | 0.98 | 2.2 | 0.008 | 0.0029 | 0.0006 | 0.030 | 0.02 | 5.3 | 0.01 | — |

| | Chemical components (mass %) | | | | | | | | | |
|---|---|---|---|---|---|---|---|---|---|---|
| Steel No. | Mo | Zr | B | Ca | Cu | Ni | Ce | La | ([Ce] + [La])/[Acid-soluble Al] | ([Ce] + [La])/[S] |
| B1 | — | — | — | — | — | — | 0.004 | — | 0.16 | 2.67 |
| B2 | — | — | — | — | — | — | 0.006 | — | 0.18 | 2.00 |
| B3 | — | — | — | 0.001 | — | — | — | 0.005 | 0.12 | 1.61 |
| B4 | — | — | — | — | — | — | — | 0.004 | 0.11 | 0.78 |
| B5 | — | — | — | — | — | 0.05 | 0.002 | 0.002 | 0.10 | 0.82 |
| B6 | — | — | — | — | — | — | 0.001 | 0.003 | 0.11 | 4.03 |
| B7 | — | — | 0.001 | — | — | — | 0.002 | 0.004 | 0.20 | 2.46 |
| B8 | — | — | 0.001 | — | — | — | 0.005 | — | 0.16 | 1.67 |
| B9 | 0.10 | — | — | — | — | 0.05 | — | 0.006 | 0.14 | 1.44 |
| b1 | — | — | — | — | — | — | — | 0.001 | 0.02 | 0.28 |
| b2 | — | — | — | 0.001 | — | — | — | — | 0.00 | 0.00 |
| b3 | — | — | — | — | — | 0.05 | — | — | 0.00 | 0.00 |
| b4 | 0.15 | — | 0.002 | — | — | — | 0.001 | — | 0.03 | 0.34 |
| b5 | — | — | 0.001 | — | — | — | — | — | 0.00 | 0.00 |
| b6 | 0.10 | 0.005 | — | — | — | 0.05 | — | — | 0.00 | 0.00 |
| b7 | — | — | — | — | — | — | 0.040 | 0.040 | 3.19 | 53.33 |
| b8 | — | — | — | — | — | — | 0.035 | 0.030 | 1.88 | 64.01 |
| b9 | 0.10 | 0.005 | — | — | — | 0.05 | 0.002 | 0.002 | 0.09 | 0.90 |
| b10 | — | — | — | — | — | — | 0.002 | 0.001 | 0.08 | 1.04 |
| b11 | — | — | 0.001 | — | — | — | 0.005 | 0.000 | 1.14 | 1.74 |

* "—" indicates that the corresponding chemical element is not added.

*The underlines in this Table indicate that the corresponding amount does not satisfy the conditions of the chemical components according to the present invention.

TABLE 3

| | Chemical components (mass %) | | | | | | | | | | |
|---|---|---|---|---|---|---|---|---|---|---|---|
| Steel No. | C | Si | Mn | P | S | N | Acid-soluble Al | Acid-soluble Ti | Cr | Nb | V |
| C1 | 0.040 | 0.42 | 1.8 | 0.015 | 0.0029 | 0.0027 | 0.042 | 0.050 | — | 0.01 | — |
| C2 | 0.110 | 0.92 | 2.2 | 0.015 | 0.0025 | 0.0035 | 0.039 | 0.002 | — | — | — |
| C3 | 0.165 | 1.45 | 2.5 | 0.008 | 0.0029 | 0.0025 | 0.040 | 0.004 | — | 0.01 | — |
| C4 | 0.130 | 1.00 | 2.2 | 0.010 | 0.0002 | 0.0036 | 0.030 | 0.010 | — | 0.03 | 0.05 |
| C5 | 0.060 | 0.70 | 2.0 | 0.010 | 0.0072 | 0.0035 | 0.039 | 0.040 | — | — | — |
| C6 | 0.161 | 1.20 | 2.8 | 0.010 | 0.0038 | 0.0035 | 0.040 | 0.004 | — | 0.02 | — |
| C7 | 0.110 | 1.10 | 2.1 | 0.012 | 0.0035 | 0.0034 | 0.038 | 0.002 | — | — | — |
| C8 | 0.080 | 0.87 | 1.5 | 0.009 | 0.0004 | 0.0033 | 0.032 | — | — | — | — |
| C9 | 0.080 | 0.60 | 2.0 | 0.011 | 0.0105 | 0.0035 | 0.103 | 0.020 | — | 0.02 | — |
| C10 | 0.190 | 1.70 | 2.5 | 0.010 | 0.0420 | 0.0040 | 0.105 | 0.006 | 0.6 | — | — |
| c1 | 0.250 | 0.62 | 4.2 | 0.012 | 0.0039 | 0.0025 | 0.041 | — | 0.4 | — | — |
| c2 | 0.110 | 0.05 | 2.2 | 0.010 | 0.0040 | 0.0036 | 1.900 | 0.010 | — | — | — |
| c3 | 0.330 | 1.02 | 1.8 | 0.012 | 0.0035 | 0.0025 | 0.032 | — | — | — | — |

| Steel | Chemical components (mass %) | | | | | | | | | ([Ce] + [La])/[Acid-soluble | ([Ce] + [La])/ |
|---|---|---|---|---|---|---|---|---|---|---|---|
| No. | Mo | Zr | B | Mg | W | Ni | Others | Ce | La | Al] | [S] |

TABLE 3-continued

| | | | | | | | | | | | |
|---|---|---|---|---|---|---|---|---|---|---|---|
| C1 | 0.05 | — | — | — | 0.4 | — | — | 0.0010 | 0.0020 | 0.07 | 1.04 |
| C2 | — | — | — | — | — | — | — | 0.0013 | 0.0024 | 0.09 | 1.48 |
| C3 | — | — | 0.001 | 0.004 | — | — | — | 0.0025 | — | 0.06 | 0.87 |
| C4 | — | — | — | — | — | — | — | 0.0015 | 0.0010 | 0.08 | 12.50 |
| C5 | — | — | — | — | — | — | As:0.02, Co:0.02, Sm:0.002 | 0.0010 | 0.0020 | 0.08 | 0.42 |
| C6 | — | — | — | — | — | — | Sn:0.04, Pb:0.05 | 0.0030 | — | 0.08 | 0.79 |
| C7 | — | — | — | — | — | — | Dy:0.003, Nd:0.003 | 0.0015 | 0.0020 | 0.09 | 1.00 |
| C8 | — | — | — | — | — | — | Y:0.002, Hf:0.0025 | — | 0.0022 | 0.07 | 5.50 |
| C9 | — | — | — | — | — | — | — | 0.0100 | 0.0120 | 0.12 | 1.14 |
| C10 | — | — | — | — | — | — | — | 0.0150 | 0.0210 | 0.20 | 0.50 |
| c1 | 0.10 | 0.005 | — | — | — | 0.05 | — | 0.0015 | 0.0020 | 0.09 | 0.90 |
| c2 | — | — | — | — | — | — | — | 0.0090 | 0.0010 | 0.01 | 2.50 |
| c3 | — | — | — | — | — | — | — | 0.0020 | 0.0025 | 0.08 | 1.29 |

* "—" indicates that the corresponding chemical element is not added.

*The underlines in this Table indicate that the corresponding amount does not satisfy the conditions of the chemical components according to the present invention.

TABLE 4

| | | Hot-rolled conditions | | | Mechanical properties | | | |
|---|---|---|---|---|---|---|---|---|
| Steel sheet No. | Steel No. | Heating temperature ° C. | Finishing temperature ° C. | Coiling temperature ° C. | Tensile strength TS MPA | Elongation El % | Hole expansion λ % | TS × El × λ |
| A1-h1 | A1 | 1180 | 900 | 350 | 572 | 30.2 | 94 | 1.6E+06 |
| A1-h2 | A1 | 1160 | 890 | 180 | 645 | 28.2 | 51 | 9.3E+05 |
| A2-h1 | A2 | 1180 | 900 | 360 | 745 | 23.4 | 76 | 1.3E+06 |
| A2-h2 | A2 | 1170 | 880 | 110 | 802 | 20.8 | 38 | 6.3E+05 |
| A3-h1 | A3 | 1200 | 890 | 380 | 720 | 24.5 | 79 | 1.4E+06 |
| A3-h2 | A3 | 1170 | 900 | 100 | 813 | 21.2 | 33 | 5.7E+05 |
| A4-h1 | A4 | 1150 | 880 | 330 | 932 | 17.8 | 67 | 1.1E+06 |
| A4-h2 | A4 | 1180 | 870 | 180 | 1023 | 16.1 | 31 | 5.1E+05 |
| A5-h1 | A5 | 1190 | 880 | 400 | 1072 | 14.6 | 62 | 9.6E+05 |
| A5-h2 | A5 | 1170 | 900 | 150 | 1196 | 15.6 | 21 | 3.9E+05 |
| A6-h1 | A6 | 1200 | 890 | 330 | 1068 | 15.3 | 65 | 1.1E+06 |
| A6-h2 | A6 | 1180 | 900 | 130 | 1236 | 14.2 | 23 | 4.0E+05 |
| a1-h1 | a1 | 1180 | 900 | 360 | 569 | 30.1 | 65 | 1.1E+06 |
| a2-h1 | a2 | 1200 | 890 | 410 | 1098 | 14.8 | 42 | 6.8E+05 |
| a3-h1 | a3 | 1160 | 870 | 400 | 725 | 24.2 | 54 | 9.5E+05 |
| a4-h1 | a4 | 1190 | 860 | 340 | 562 | 31.2 | 62 | 1.1E+06 |
| a5-h1 | a5 | 1210 | 900 | 370 | 932 | 18.2 | 45 | 7.6E+05 |
| a6-h1 | a6 | 1250 | 910 | 320 | 921 | 8.8 | 45 | 3.6E+05 |
| a7-h1 | a7 | 1200 | 880 | 350 | 1320 | 7.2 | 55 | 5.2E+05 |

* The underlines in the Table indicate that the corresponding cell does not satisfy the manufacturing conditions according to the present invention.

TABLE 5

| | | Hot-rolled conditions | | | Mechanical properties | | | |
|---|---|---|---|---|---|---|---|---|
| Steel sheet No. | Steel No. | Heating temperature ° C. | Finishing temperature ° C. | Coiling temperature ° C. | Tensile strength TS MPA | Elongation El % | Hole expansion λ % | TS × El × λ |
| B1-h1 | B1 | 1250 | 900 | 360 | 575 | 30.8 | 95 | 1.7E+06 |
| B1-h2 | B1 | 1250 | 890 | 180 | 643 | 28.2 | 55 | 1.0E+06 |
| B2-h1 | B2 | 1250 | 900 | 360 | 531 | 32.3 | 108 | 1.9E+06 |
| B2-h2 | B2 | 1250 | 880 | 110 | 646 | 26.8 | 51 | 8.8E+05 |
| B3-h1 | B3 | 1250 | 880 | 330 | 760 | 22.6 | 78 | 1.3E+06 |
| B3-h2 | B3 | 1250 | 870 | 180 | 837 | 19.0 | 42 | 6.7E+05 |
| B4-h1 | B4 | 1250 | 900 | 390 | 777 | 22.7 | 77 | 1.4E+06 |
| B4-h2 | B4 | 1250 | 880 | 150 | 835 | 19.9 | 40 | 6.7E+05 |

TABLE 5-continued

| Steel sheet No. | Steel No. | Hot-rolled conditions: Heating temperature ° C. | Finishing temperature ° C. | Coiling temperature ° C. | Mechanical properties: Tensile strength TS MPA | Elongation El % | Hole expansion λ % | TS × El × λ |
|---|---|---|---|---|---|---|---|---|
| B5-h1 | B5 | 1250 | 900 | 310 | 783 | 21.4 | 73 | 1.2E+06 |
| B5-h2 | B5 | 1250 | 810 | 100 | 845 | 18.2 | 42 | 6.5E+05 |
| B6-h1 | B6 | 1250 | 890 | 330 | 964 | 15.7 | 57 | 8.7E+05 |
| B6-h2 | B6 | 1250 | 900 | 180 | 1086 | 15.1 | 35 | 5.7E+05 |
| B7-h1 | B7 | 1250 | 880 | 350 | 1075 | 14.1 | 52 | 7.9E+05 |
| B7-h2 | B7 | 1250 | 890 | 150 | 1199 | 12.8 | 38 | 5.8E+05 |
| B8-h1 | B8 | 1210 | 870 | 370 | 1062 | 14.0 | 59 | 8.8E+05 |
| B8-h2 | B8 | 1200 | 880 | 180 | 1250 | 14.2 | 35 | 6.2E+05 |
| B9-h1 | B9 | 1210 | 900 | 390 | 1156 | 14.1 | 48 | 7.8E+05 |
| B9-h2 | B9 | 1210 | 880 | 160 | 1235 | 12.9 | 32 | 5.1E+05 |
| b1-h1 | b1 | 1250 | 890 | 360 | 533 | 33.1 | 76 | 1.33E+06 |
| b2-h1 | b2 | 1250 | 870 | 330 | 754 | 22.7 | 55 | 9.33E+05 |
| b3-h1 | b3 | 1250 | 910 | 310 | 777 | 21.3 | 51 | 8.43E+05 |
| b4-h1 | b4 | 1250 | 900 | 360 | 950 | 16.8 | 41 | 6.58E+05 |
| b5-h1 | b5 | 1250 | 880 | 350 | 1070 | 15.2 | 36 | 5.92E+05 |
| b6-h1 | b6 | 1210 | 870 | 370 | 1053 | 13.8 | 41 | 6.00E+05 |
| b7-h1 | b7 | 1250 | 900 | 360 | 574 | 31.3 | 67 | 1.20E+06 |
| b8-h1 | b8 | 1250 | 890 | 330 | 954 | 15.7 | 40 | 5.97E+05 |
| b9-h1 | b9 | 1250 | 880 | 350 | 1170 | 8.1 | 32 | 3.05E+05 |
| b10-h1 | b10 | 1250 | 880 | 320 | 905 | 9.1 | 45 | 3.72E+05 |
| b11-h1 | b11 | 1250 | 890 | 350 | 1313 | 7.1 | 50 | 4.65E+05 |

* The underlines in the Table indicate that the corresponding cell does not satisfy the manufacturing conditions according to the present invention.

TABLE 6

| Steel sheet No. | Steel No. | Hot-rolled conditions: Heating temperature ° C. | Finishing temperature ° C. | Coiling temperature ° C. | Mechanical properties: Tensile strength TS MPA | Elongation El % | Hole expansion λ % | TS × El × λ |
|---|---|---|---|---|---|---|---|---|
| C1-h1 | C1 | 1250 | 920 | 380 | 552 | 31.2 | 123 | 2.1E+06 |
| C1-h2 | C1 | 1250 | 910 | 150 | 623 | 29.2 | 61 | 1.1E+06 |
| C2-h1 | C2 | 1200 | 890 | 350 | 983 | 16.6 | 76 | 1.2E+06 |
| C2-h2 | C2 | 1200 | 900 | 180 | 1092 | 15.3 | 39 | 6.5E+05 |
| C3-h1 | C3 | 1250 | 950 | 400 | 1176 | 14.9 | 65 | 1.1E+06 |
| C3-h2 | C3 | 1250 | 940 | 180 | 1265 | 13.8 | 31 | 5.4E+05 |
| C4-h1 | C4 | 1250 | 910 | 450 | 892 | 19.2 | 81 | 1.4E+06 |
| C4-h2 | C4 | 1250 | 930 | 160 | 1024 | 17.6 | 38 | 6.8E+05 |
| C5-h1 | C5 | 1200 | 880 | 350 | 621 | 27.8 | 121 | 2.1E+06 |
| C5-h2 | C5 | 1200 | 880 | 180 | 644 | 28.4 | 58 | 1.1E+06 |
| C6-h1 | C6 | 1250 | 880 | 380 | 1206 | 14.2 | 68 | 1.2E+06 |
| C6-h2 | C6 | 1250 | 890 | 150 | 1289 | 12.4 | 28 | 4.5E+05 |
| C7-h1 | C7 | 1200 | 900 | 400 | 945 | 18.6 | 76 | 1.3E+06 |
| C7-h2 | C7 | 1200 | 920 | 180 | 1056 | 16.2 | 36 | 6.2E+05 |
| C8-h1 | C8 | 1250 | 880 | 330 | 561 | 32.6 | 119 | 2.2E+06 |
| C8-h2 | C8 | 1250 | 890 | 160 | 603 | 30.1 | 67 | 1.2E+06 |
| C9-h1 | C9 | 1250 | 930 | 300 | 702 | 26.8 | 102 | 1.9E+06 |
| C9-h2 | C9 | 1250 | 930 | 150 | 791 | 24.1 | 42 | 8.0E+05 |
| C10-h1 | C10 | 1200 | 880 | 320 | 1191 | 16.3 | 78 | 1.5E+06 |
| C10-h2 | C10 | 1200 | 880 | 130 | 1253 | 13.4 | 21 | 3.5E+05 |
| c1-h1 | c1 | 1150 | 880 | 380 | 1024 | 9.3 | 35 | 3.3E+05 |
| c2-h1 | c2 | 1200 | 900 | 350 | 989 | 18.2 | 32 | 5.8E+05 |
| c3-h1 | c3 | 1200 | 920 | 380 | 773 | 9.3 | 31 | 3.3E+05 |

* The underlines in the Table indicate that the corresponding cell does not satisfy the manufacturing conditions according to the present invention.

TABLE 7

| | | | Elongated inclusions | | | Inclusions including sulfides | | | | |
|---|---|---|---|---|---|---|---|---|---|---|
| | | Fine inclusions | | Volume number | Average equivalent | | Volume number | Average | Martensite phase | |
| Steel sheet No. | Steel No. | Area number density inclusion/mm$^2$ | Number percentage % | density inclusion/ mm$^3$ | circle diameter μm | Number percentage % | density inclusion/ mm$^3$ | concentration of [Ce] + [La] % | Ratio % | Maximum hardness HV |
| A1-h1 | A1 | 42 | 0 | 0 | 6 | 83 | $2.5 \times 10^4$ | 34 | 10.2 | 487 |
| A1-h2 | A1 | 41 | 1 | 0 | 6 | 82 | $2.8 \times 10^4$ | 38 | 10.4 | 643 |
| A2-h1 | A2 | 42 | 0 | 0 | 5 | 84 | $2.4 \times 10^4$ | 40 | 18.2 | 516 |
| A2-h2 | A2 | 41 | 1 | 0 | 6 | 83 | $2.8 \times 10^4$ | 28 | 16.4 | 665 |
| A3-h1 | A3 | 38 | 1 | 0 | 9 | 81 | $2.3 \times 10^4$ | 31 | 16.2 | 534 |
| A3-h2 | A3 | 42 | 0 | 0 | 9 | 90 | $2.5 \times 10^4$ | 33 | 16.4 | 681 |
| A4-h1 | A4 | 36 | 1 | 0 | 5 | 88 | $2.1 \times 10^4$ | 28 | 26.1 | 549 |
| A4-h2 | A4 | 37 | 1 | 0 | 7 | 92 | $2.8 \times 10^4$ | 40 | 25.3 | 668 |
| A5-h1 | A5 | 37 | 0 | 0 | 5 | 88 | $2.1 \times 10^4$ | 37 | 33.2 | 546 |
| A5-h2 | A5 | 35 | 1 | 0 | 8 | 91 | $2.9 \times 10^4$ | 28 | 34.6 | 630 |
| A6-h1 | A6 | 45 | 0 | 0 | 7 | 82 | $2.7 \times 10^4$ | 25 | 35.6 | 511 |
| A6-h2 | A6 | 46 | 1 | 0 | 7 | 83 | $2.5 \times 10^4$ | 31 | 34.6 | 657 |
| a1-h1 | a1 | 7 | 45 | $2.1 \times 10^4$ | 29 | 3 | $5.0 \times 10^2$ | 2 | 10.1 | 484 |
| a2-h1 | a2 | 9 | 32 | $2.8 \times 10^4$ | 17 | 0 | 0 | 0 | 32.8 | 590 |
| a3-h1 | a3 | 6 | 41 | $3.0 \times 10^4$ | 26 | 1 | 0 | 0 | 16.5 | 553 |
| a4-h1 | a4 | 52 | 0 | 0 | 7 | 89 | $2.1 \times 10^4$ | 42 | 10.7 | 447 |
| a5-h1 | a5 | 49 | 1 | 0 | 5 | 92 | $3.0 \times 10^4$ | 53 | 29.8 | 510 |
| a6-h1 | a6 | 63 | 0 | 0 | 9 | 84 | $2.0 \times 10^4$ | 18 | 31.5 | 479 |
| a7-h1 | a7 | 33 | 0 | 0 | 7 | 88 | $2.5 \times 10^4$ | 32 | 56.2 | 475 |

TABLE 8

| | | | Elongated inclusions | | | Inclusions including sulfides | | | | |
|---|---|---|---|---|---|---|---|---|---|---|
| | | Fine inclusions | | Volume number | Average equivalent | | Volume number | Average | Martensite phase | |
| Steel sheet No. | Steel No. | Area number density inclusion/mm$^2$ | Number percentage % | density inclusion/ mm$^3$ | circle diameter μm | Number percentage % | density inclusion/ mm$^3$ | concentration of [Ce] + [La] % | Ratio % | Maximum hardness HV |
| B1-h1 | B1 | 42 | 0 | 0 | 6 | 82 | $2.1 \times 10^4$ | 34 | 9.4 | 514 |
| B1-h2 | B1 | 41 | 1 | 0 | 7 | 81 | $2.8 \times 10^4$ | 36 | 9.5 | 685 |
| B2-h1 | B2 | 38 | 0 | 0 | 4 | 83 | $2.3 \times 10^4$ | 40 | 9.3 | 420 |
| B2-h2 | B2 | 37 | 0 | 0 | 8 | 81 | $2.6 \times 10^4$ | 42 | 10.3 | 657 |
| B3-h1 | B3 | 37 | 0 | 0 | 6 | 81 | $2.5 \times 10^4$ | 28 | 19.1 | 532 |
| B3-h2 | B3 | 40 | 1 | 0 | 6 | 80 | $2.6 \times 10^4$ | 30 | 17.6 | 664 |
| B4-h1 | B4 | 39 | 0 | 0 | 7 | 83 | $2.4 \times 10^4$ | 41 | 19.4 | 539 |
| B4-h2 | B4 | 38 | 0 | 0 | 8 | 84 | $2.5 \times 10^4$ | 39 | 19.8 | 613 |
| B5-h1 | B5 | 41 | 1 | 0 | 5 | 81 | $2.6 \times 10^4$ | 35 | 20.9 | 518 |
| B5-h2 | B5 | 42 | 0 | 0 | 6 | 82 | $2.4 \times 10^4$ | 37 | 18.7 | 656 |
| B6-h1 | B6 | 41 | 1 | 0 | 6 | 81 | $2.4 \times 10^4$ | 43 | 28.2 | 556 |
| B6-h2 | B6 | 39 | 0 | 0 | 5 | 80 | $2.1 \times 10^4$ | 42 | 29.7 | 627 |
| B7-h1 | B7 | 39 | 0 | 0 | 6 | 81 | $2.5 \times 10^4$ | 31 | 39.9 | 491 |
| B7-h2 | B7 | 41 | 0 | 0 | 7 | 80 | $2.0 \times 10^4$ | 33 | 36.8 | 607 |
| B8-h1 | B8 | 38 | 0 | 0 | 9 | 80 | $2.1 \times 10^4$ | 42 | 43.2 | 450 |
| B8-h2 | B8 | 42 | 1 | 0 | 7 | 80 | $2.5 \times 10^4$ | 43 | 37.4 | 624 |
| B9-h1 | B9 | 39 | 0 | 0 | 6 | 83 | $2.3 \times 10^4$ | 40 | 40.8 | 523 |
| B9-h2 | B9 | 36 | 0 | 0 | 5 | 81 | $2.8 \times 10^4$ | 39 | 37.4 | 618 |
| b1-h1 | b1 | 5 | 45 | $2.1 \times 10^4$ | 29 | 0 | $5.0 \times 10^2$ | 1 | 9.2 | 423 |
| b2-h1 | b2 | 7 | 32 | $2.8 \times 10^4$ | 17 | 0 | 0 | 0 | 18.9 | 537 |
| b3-h1 | b3 | 6 | 41 | $3.0 \times 10^4$ | 26 | 0 | 0 | 0 | 20.4 | 528 |
| b4-h1 | b4 | 4 | 40 | $2.3 \times 10^4$ | 25 | 0 | $5.0 \times 10^2$ | 1 | 29.3 | 531 |
| b5-h1 | b5 | 6 | 42 | $2.7 \times 10^4$ | 24 | 0 | 0 | 0 | 38.9 | 502 |
| b6-h1 | b6 | 4 | 40 | $3.0 \times 10^4$ | 23 | 0 | 0 | 0 | 42.2 | 458 |
| b7-h1 | b7 | 55 | 1 | 0 | 6 | 89 | $2.1 \times 10^4$ | 68 | 9.0 | 534 |
| b8-h1 | b8 | 63 | 2 | 0 | 5 | 91 | $3.0 \times 10^4$ | 72 | 27.5 | 568 |
| b9-h1 | b9 | 34 | 0 | 0 | 6 | 81 | $1.8 \times 10^4$ | 21 | 59.9 | 397 |
| b10-h1 | b10 | 41 | 0 | 0 | 9 | 84 | $2.0 \times 10^4$ | 18 | 29.2 | 494 |
| b11-h1 | b11 | 33 | 0 | 0 | 7 | 88 | $2.5 \times 10^4$ | 32 | 49.8 | 515 |

TABLE 9

| Steel sheet No. | Steel No. | Fine inclusions: Area number density inclusion/mm$^2$ | Elongated inclusions: Number percentage % | Elongated inclusions: Volume number density inclusion/mm$^3$ | Elongated inclusions: Average equivalent circle diameter μm | Inclusions including sulfides: Number percentage % | Inclusions including sulfides: Volume number density inclusion/mm$^3$ | Inclusions including sulfides: Average concentration of [Ce] + [La] % | Martensite phase: Ratio % | Martensite phase: Maximum hardness HV |
|---|---|---|---|---|---|---|---|---|---|---|
| C1-h1 | C1 | 42 | 1 | 0 | 7 | 82 | $2.6 \times 10^4$ | 32 | 2.5 | 580 |
| C1-h2 | C1 | 45 | 0 | 0 | 8 | 80 | $2.0 \times 10^4$ | 34 | 3 | 725 |
| C2-h1 | C2 | 38 | 0 | 0 | 5 | 83 | $2.1 \times 10^4$ | 33 | 29 | 515 |
| C2-h2 | C2 | 36 | 1 | 0 | 6 | 85 | $2.2 \times 10^4$ | 35 | 32 | 656 |
| C3-h1 | C3 | 42 | 0 | 0 | 7 | 80 | $2.0 \times 10^4$ | 36 | 42 | 536 |
| C3-h2 | C3 | 48 | 0 | 0 | 7 | 84 | $2.3 \times 10^4$ | 39 | 39 | 672 |
| C4-h1 | C4 | 25 | 1 | 0 | 6 | 81 | $2.5 \times 10^4$ | 35 | 28 | 492 |
| C4-h2 | C4 | 27 | 1 | 0 | 7 | 80 | $2.2 \times 10^4$ | 37 | 26 | 648 |
| C5-h1 | C5 | 41 | 1 | 0 | 7 | 81 | $2.0 \times 10^4$ | 34 | 5.5 | 550 |
| C5-h2 | C5 | 44 | 1 | 0 | 8 | 80 | $2.5 \times 10^4$ | 31 | 6 | 783 |
| C6-h1 | C6 | 40 | 0 | 0 | 8 | 81 | $2.1 \times 10^4$ | 32 | 45 | 563 |
| C6-h2 | C6 | 46 | 0 | 0 | 7 | 83 | $2.7 \times 10^4$ | 36 | 42 | 692 |
| C7-h1 | C7 | 27 | 0 | 0 | 6 | 80 | $2.2 \times 10^4$ | 34 | 25 | 521 |
| C7-h2 | C7 | 28 | 0 | 0 | 6 | 82 | $2.3 \times 10^4$ | 36 | 27 | 666 |
| C8-h1 | C8 | 21 | 0 | 0 | 6 | 88 | $1.6 \times 10^4$ | 42 | 6 | 569 |
| C8-h2 | C8 | 22 | 0 | 0 | 7 | 85 | $1.7 \times 10^4$ | 39 | 7 | 702 |
| C9-h1 | C9 | 76 | 1 | 0 | 8 | 81 | $4.3 \times 10^4$ | 25 | 13 | 563 |
| C9-h2 | C9 | 82 | 1 | 0 | 7 | 76 | $3.9 \times 10^4$ | 27 | 14 | 673 |
| C10-h1 | C10 | 103 | 1 | $1.0 \times 10^3$ | 8 | 79 | $6.2 \times 10^4$ | 24 | 42 | 562 |
| C10-h2 | C10 | 111 | 1 | $1.0 \times 10^3$ | 9 | 83 | $5.8 \times 10^4$ | 25 | 41 | 715 |
| c1-h1 | c1 | 25 | 2 | $1.0 \times 10^3$ | 7 | 85 | $1.3 \times 10^4$ | 18 | 48 | 556 |
| c2-h1 | c2 | 10 | 5 | $3.0 \times 10^3$ | 9 | 8 | $5.0 \times 10^2$ | 5 | 25 | 582 |
| c3-h1 | c3 | 26 | 1 | $1.0 \times 10^3$ | 8 | 82 | $1.5 \times 10^4$ | 21 | 26 | 571 |

With regard to cold-rolled steel sheets, firstly, steels having the above chemical compositions were cast, heated to 1150° C. or higher, subjected to hot rolling in a finishing temperature of 850° C. to 910° C., cooled at an average cooling rate of 30° C./second, and coiled at a coiling temperature of 450° C. to 610° C., thereby producing 2.8 mm to 3.2 mm-thick hot-rolled steel sheets. After that, the hot-rolled steel sheets were pickled, and then subjected to cold rolling, annealing, and holding under the conditions as shown in Tables 10 to 12, thereby producing cold-rolled steel sheets. The manufacturing conditions and mechanical properties of the cold-rolled steel sheets are shown in Tables 10 to 12 and the microstructures of the cold-rolled steel sheets are shown in Tables 13 to 15. The sheet thicknesses of the cold-rolled steel sheets were 0.5 mm to 2.4 mm.

TABLE 10

| Steel sheet No. | Steel No. | Hot-rolled conditions: Heating temperature ° C. | Hot-rolled conditions: Finishing temperature ° C. | Hot-rolled conditions: Coiling temperature ° C. | Cold-rolled conditions: Reduction % | Cold-rolled conditions: Annealing temperature ° C. | Cold-rolled conditions: Average cooling rate ° C. | Cold-rolled conditions: Holding temperature ° C. | Cold-rolled conditions: Holding time s | Cold-rolled conditions: Sheet thickness mm | Mechanical properties: Tensile strength TS MPa | Mechanical properties: Elongation El % | Mechanical properties: Hole expansion λ % | TS × El × λ |
|---|---|---|---|---|---|---|---|---|---|---|---|---|---|---|
| A1-c1 | A1 | 1180 | 900 | 600 | 55 | 790 | 14 | 350 | 330 | 0.8 | 562 | 32.2 | 102 | 1.8E+06 |
| A1-c2 | A1 | 1160 | 890 | 580 | 55 | 790 | 18 | 250 | 330 | 0.8 | 662 | 28.2 | 48 | 9.0E+05 |
| A2-c1 | A2 | 1180 | 900 | 590 | 55 | 810 | 14 | 380 | 300 | 1.6 | 722 | 24.3 | 75 | 1.3E+06 |
| A2-c2 | A2 | 1170 | 880 | 610 | 55 | 810 | 17 | 280 | 300 | 1.6 | 791 | 20.3 | 38 | 6.1E+05 |
| A3-c1 | A3 | 1200 | 890 | 500 | 60 | 810 | 15 | 340 | 320 | 1.2 | 720 | 22.0 | 81 | 1.3E+06 |
| A3-c2 | A3 | 1170 | 900 | 510 | 60 | 810 | 19 | 240 | 320 | 1.2 | 813 | 19.8 | 35 | 5.6E+05 |
| A4-c1 | A4 | 1150 | 880 | 450 | 60 | 830 | 16 | 350 | 320 | 1.4 | 945 | 17.5 | 71 | 1.2E+06 |
| A4-c2 | A4 | 1180 | 870 | 480 | 60 | 830 | 19 | 260 | 320 | 1.4 | 1032 | 15.9 | 28 | 4.6E+05 |
| A5-c1 | A5 | 1190 | 880 | 560 | 50 | 800 | 14 | 380 | 350 | 1.2 | 1082 | 13.2 | 59 | 8.4E+05 |
| A5-c2 | A5 | 1170 | 900 | 570 | 50 | 800 | 17 | 280 | 350 | 1.2 | 1203 | 13.9 | 19 | 3.2E+05 |
| A6-c1 | A6 | 1200 | 890 | 540 | 60 | 810 | 15 | 350 | 350 | 0.6 | 1072 | 15.8 | 67 | 1.1E+06 |
| A6-c2 | A6 | 1180 | 900 | 520 | 60 | 810 | 18 | 250 | 350 | 0.6 | 1251 | 13.1 | 17 | 2.8E+05 |
| a1-c1 | a1 | 1180 | 900 | 590 | 55 | 810 | 15 | 350 | 330 | 2.1 | 572 | 30.1 | 59 | 1.0E+06 |
| a2-c1 | a2 | 1200 | 890 | 550 | 50 | 800 | 14 | 380 | 350 | 0.9 | 1075 | 13.1 | 43 | 6.1E+05 |
| a3-c1 | a3 | 1160 | 870 | 490 | 60 | 810 | 15 | 340 | 320 | 1.5 | 725 | 23.8 | 51 | 8.8E+05 |
| a4-c1 | a4 | 1190 | 850 | 400 | 55 | 810 | 13 | 400 | 300 | 2.3 | 557 | 33.2 | 67 | 1.2E+06 |
| a5-c1 | a5 | 1210 | 900 | 520 | 60 | 850 | 15 | 340 | 300 | 1.6 | 941 | 18.9 | 44 | 7.8E+05 |
| a6-c1 | a6 | 1250 | 910 | 570 | 55 | 800 | 14 | 380 | 300 | 1.4 | 932 | 8.2 | 47 | 3.6E+05 |
| a7-c1 | a7 | 1200 | 880 | 570 | 50 | 800 | 14 | 380 | 350 | 0.7 | 1280 | 7.3 | 51 | 4.8E+05 |

* The underlines in the Table indicate that the corresponding cell does not satisfy the manufacturing conditions according to the present invention.

TABLE 11

| | | Hot-rolled conditions | | | Cold-rolled conditions | | | | | | Mechanical properties | | | |
|---|---|---|---|---|---|---|---|---|---|---|---|---|---|---|
| Steel sheet No. | Steel No. | Heating temperature ° C. | Finishing temperature ° C. | Coiling temperature ° C. | Reduction % | Annealing temperature ° C. | Average cooling rate ° C. | Holding temperature ° C. | Holding time s | Sheet thickness mm | Tensile strength TS MPa | Elongation El % | Hole expansion λ % | TS × El × λ |
| B1-c1 | B1 | 1250 | 900 | 500 | 60 | 810 | 15 | 350 | 330 | 2.1 | 547 | 31.5 | 105 | 1.8E+06 |
| B1-c2 | B1 | 1250 | 900 | 510 | 60 | 810 | 18 | 250 | 330 | 2.1 | 623 | 28.8 | 61 | 1.1E+06 |
| B2-c1 | B2 | 1250 | 910 | 580 | 55 | 870 | 16 | 380 | 300 | 0.7 | 535 | 33.1 | 115 | 2.0E+06 |
| B2-c2 | B2 | 1250 | 910 | 600 | 55 | 870 | 19 | 280 | 300 | 0.7 | 658 | 27.8 | 55 | 1.0E+06 |
| B3-c1 | B3 | 1250 | 880 | 490 | 60 | 790 | 15 | 330 | 360 | 1.0 | 785 | 22.1 | 78 | 1.4E+06 |
| B3-c2 | B3 | 1250 | 890 | 480 | 60 | 790 | 17 | 260 | 360 | 1.0 | 804 | 20.6 | 63 | 1.0E+06 |
| B4-c1 | B4 | 1250 | 900 | 560 | 55 | 800 | 13 | 400 | 360 | 0.8 | 759 | 22.9 | 85 | 1.5E+06 |
| B4-c2 | B4 | 1250 | 900 | 550 | 55 | 800 | 20 | 200 | 360 | 0.8 | 853 | 19.8 | 58 | 9.8E+05 |
| B5-c1 | B5 | 1250 | 910 | 590 | 50 | 810 | 16 | 320 | 330 | 0.5 | 763 | 23.4 | 88 | 1.6E+06 |
| B5-c2 | B5 | 1250 | 900 | 600 | 50 | 810 | 18 | 250 | 330 | 0.5 | 841 | 19.2 | 56 | 9.0E+05 |
| B6-c1 | B6 | 1250 | 900 | 580 | 60 | 850 | 15 | 380 | 330 | 1.2 | 916 | 18.2 | 75 | 1.3E+06 |
| B6-c2 | B6 | 1250 | 900 | 570 | 60 | 850 | 20 | 250 | 330 | 1.2 | 1074 | 15.0 | 36 | 5.8E+05 |
| B7-c1 | B7 | 1250 | 900 | 580 | 60 | 800 | 14 | 380 | 250 | 1.2 | 1086 | 14.3 | 58 | 9.0E+05 |
| B7-c2 | B7 | 1250 | 900 | 590 | 60 | 800 | 18 | 250 | 250 | 1.2 | 1254 | 12.8 | 28 | 4.5E+05 |
| B8-c1 | B8 | 1220 | 900 | 610 | 55 | 820 | 17 | 310 | 300 | 1.4 | 1036 | 14.7 | 63 | 9.6E+05 |
| B8-c2 | B8 | 1210 | 890 | 590 | 55 | 820 | 18 | 280 | 300 | 1.4 | 1251 | 14.5 | 31 | 5.6E+05 |
| B9-c1 | B9 | 1210 | 890 | 550 | 50 | 820 | 15 | 350 | 330 | 2.0 | 1132 | 14.4 | 54 | 8.8E+05 |
| B9-c2 | B9 | 1220 | 880 | 540 | 50 | 820 | 19 | 250 | 330 | 2.0 | 1207 | 13.9 | 29 | 4.9E+05 |
| b1-c1 | b1 | 1250 | 900 | 590 | 55 | 870 | 16 | 380 | 300 | 1.8 | 524 | 32.4 | 79 | 1.3E+06 |
| b2-c1 | b2 | 1250 | 900 | 500 | 60 | 790 | 15 | 330 | 360 | 0.7 | 779 | 22.5 | 54 | 9.5E+05 |
| b3-c1 | b3 | 1250 | 890 | 600 | 50 | 810 | 16 | 320 | 330 | 0.9 | 771 | 22.2 | 61 | 1.0E+06 |
| b4-c1 | b4 | 1250 | 900 | 540 | 60 | 810 | 15 | 350 | 360 | 1.0 | 939 | 17.1 | 48 | 7.7E+05 |
| b5-c1 | b5 | 1250 | 890 | 600 | 60 | 800 | 14 | 380 | 250 | 1.4 | 1109 | 14.6 | 37 | 6.0E+05 |
| b6-c1 | b6 | 1200 | 910 | 600 | 55 | 820 | 17 | 310 | 300 | 0.6 | 1045 | 14.2 | 41 | 6.1E+05 |
| b7-c1 | b7 | 1250 | 900 | 510 | 60 | 810 | 15 | 380 | 330 | 1.2 | 554 | 31.1 | 72 | 1.2E+06 |
| b8-c1 | b8 | 1250 | 890 | 580 | 60 | 850 | 15 | 380 | 360 | 1.6 | 914 | 17.3 | 48 | 7.6E+05 |
| b9-c1 | b9 | 1250 | 900 | 500 | 55 | 810 | 15 | 350 | 350 | 0.6 | 1216 | 8.0 | 38 | 3.7E+05 |
| b10-c1 | b10 | 1250 | 910 | 550 | 55 | 850 | 16 | 350 | 300 | 1.1 | 887 | 8.8 | 48 | 3.7E+05 |
| b11-c1 | b11 | 1250 | 880 | 570 | 50 | 880 | 19 | 310 | 350 | 1.2 | 1347 | 7.0 | 31 | 2.9E+05 |

* The underlines in the Table indicate that the corresponding cell does not satisfy the manufacturing conditions according to the present invention.

TABLE 12

| | | Hot-rolled conditions | | | Cold-rolled conditions | | | | | | Mechanical properties | | | |
|---|---|---|---|---|---|---|---|---|---|---|---|---|---|---|
| Steel sheet No. | Steel No. | Heating temperature ° C. | Finishing temperature ° C. | Coiling temperature ° C. | Reduction % | Annealing temperature ° C. | Average cooling rate ° C. | Holding temperature ° C. | Holding time s | Sheet thickness mm | Tensile strength TS MPa | Elongation El % | Hole expansion λ % | TS × El × λ |
| C1-h1 | C1 | 1250 | 900 | 500 | 45 | 810 | 15 | 350 | 330 | 1.6 | 572 | 31.1 | 129 | 2.3E+06 |
| C1-h2 | C1 | 1250 | 900 | 510 | 45 | 810 | 18 | 250 | 330 | 1.6 | 621 | 32.3 | 58 | 1.2E+06 |
| C2-h1 | C2 | 1200 | 880 | 550 | 60 | 850 | 14 | 300 | 300 | 1.3 | 983 | 16.8 | 76 | 1.3E+06 |
| C2-h2 | C2 | 1200 | 880 | 550 | 60 | 850 | 17 | 220 | 300 | 1.3 | 1092 | 15.6 | 39 | 6.6E+05 |
| C3-h1 | C3 | 1250 | 900 | 550 | 55 | 820 | 18 | 320 | 300 | 1.4 | 1176 | 15.5 | 65 | 1.2E+06 |
| C3-h2 | C3 | 1250 | 900 | 550 | 55 | 820 | 22 | 200 | 300 | 1.4 | 1265 | 14.5 | 31 | 5.7E+05 |
| C4-h1 | C4 | 1250 | 900 | 500 | 55 | 860 | 15 | 380 | 400 | 1.7 | 892 | 19.2 | 81 | 1.4E+06 |
| C4-h2 | C4 | 1250 | 900 | 500 | 55 | 860 | 18 | 250 | 400 | 1.7 | 1024 | 17.6 | 38 | 6.8E+05 |
| C5-h1 | C5 | 1200 | 880 | 600 | 80 | 820 | 16 | 350 | 600 | 0.8 | 601 | 30.1 | 121 | 2.2E+06 |
| C5-h2 | C5 | 1200 | 880 | 610 | 80 | 820 | 21 | 180 | 600 | 0.8 | 647 | 30.3 | 63 | 1.2E+06 |
| C6-h1 | C6 | 1250 | 900 | 350 | 70 | 850 | 16 | 350 | 300 | 1.2 | 1201 | 14.2 | 67 | 1.1E+06 |
| C6-h2 | C6 | 1250 | 900 | 360 | 70 | 850 | 21 | 250 | 300 | 1.2 | 1296 | 14.1 | 33 | 6.0E+05 |
| C7-h1 | C7 | 1200 | 910 | 430 | 60 | 820 | 17 | 400 | 600 | 1.0 | 946 | 19.1 | 82 | 1.5E+06 |
| C7-h2 | C7 | 1200 | 910 | 450 | 60 | 820 | 23 | 250 | 600 | 1.0 | 1079 | 17.5 | 41 | 7.7E+05 |
| C8-h1 | C8 | 1250 | 880 | 550 | 65 | 860 | 7 | 300 | 500 | 2.2 | 543 | 34.2 | 112 | 2.1E+06 |
| C8-h2 | C8 | 1250 | 890 | 530 | 65 | 860 | 9 | 220 | 500 | 2.2 | 631 | 29.6 | 65 | 1.2E+06 |
| C9-h1 | C9 | 1250 | 930 | 500 | 55 | 810 | 35 | 350 | 660 | 2.4 | 697 | 23.6 | 102 | 1.7E+06 |
| C9-h2 | C9 | 1250 | 930 | 510 | 55 | 810 | 41 | 250 | 660 | 2.4 | 746 | 22.5 | 48 | 8.1E+05 |
| C10-h1 | C10 | 1200 | 880 | 550 | 60 | 820 | 53 | 400 | 320 | 1.6 | 1201 | 15.8 | 74 | 1.4E+06 |
| C10-h2 | C10 | 1200 | 880 | 550 | 60 | 820 | 62 | 220 | 320 | 1.6 | 1291 | 14.1 | 23 | 4.2E+05 |
| c1-h1 | c1 | 1150 | 880 | 600 | 60 | 810 | 7 | 350 | 300 | 1.3 | 1281 | 8.5 | 31 | 3.4E+05 |
| c2-h1 | c2 | 1200 | 880 | 600 | 60 | 820 | 15 | 330 | 300 | 0.5 | 989 | 17.6 | 32 | 5.6E+05 |
| c3-h1 | c3 | 1200 | 930 | 550 | 55 | 810 | 8 | 330 | 450 | 1.9 | 811 | 9.5 | 33 | 5.6E+05 |

* The underlines in the Table indicate that the corresponding cell does not satisfy the manufacturing conditions according to the present invention.

TABLE 13

| | | | Elongated inclusions | | | Inclusions including sulfides | | | | |
|---|---|---|---|---|---|---|---|---|---|---|
| | | Fine inclusions | | Volume number | Average equivalent | | Volume number | Average | Martensite phase | |
| Steel sheet No. | Steel No. | Area number density inclusion/mm$^2$ | Number percentage % | density inclusion/ mm$^3$ | circle diameter μm | Number percentage % | density inclusion/ mm$^3$ | concentration of [Ce] + [La] % | Ratio % | Maximum hardness HV |
| A1-c1 | A1 | 45 | 0 | 0 | 6 | 81 | $2.2 \times 10^4$ | 37 | 11.2 | 431 |
| A1-c2 | A1 | 38 | 1 | 0 | 6 | 89 | $2.5 \times 10^4$ | 41 | 9.8 | 717 |
| A2-c1 | A2 | 37 | 0 | 0 | 5 | 79 | $2.3 \times 10^4$ | 43 | 17.3 | 528 |
| A2-c2 | A2 | 38 | 1 | 0 | 6 | 88 | $3.0 \times 10^4$ | 29 | 16.8 | 636 |
| A3-c1 | A3 | 39 | 1 | 0 | 8 | 78 | $2.5 \times 10^4$ | 32 | 19.5 | 476 |
| A3-c2 | A3 | 38 | 0 | 0 | 8 | 87 | $2.2 \times 10^4$ | 33 | 17.9 | 632 |
| A4-c1 | A4 | 34 | 1 | 0 | 5 | 91 | $2.3 \times 10^4$ | 27 | 30.2 | 514 |
| A4-c2 | A4 | 35 | 1 | 0 | 7 | 85 | $2.5 \times 10^4$ | 39 | 28.3 | 614 |
| A5-c1 | A5 | 36 | 0 | 0 | 4 | 93 | $2.2 \times 10^4$ | 40 | 37.8 | 514 |
| A5-c2 | A5 | 33 | 1 | 0 | 7 | 95 | $2.7 \times 10^4$ | 29 | 34.4 | 638 |
| A6-c1 | A6 | 41 | 0 | 0 | 6 | 88 | $3.0 \times 10^4$ | 23 | 36.6 | 522 |
| A6-c2 | A6 | 45 | 1 | 0 | 6 | 76 | $2.6 \times 10^4$ | 34 | 35.2 | 657 |
| a1-c1 | a1 | 7 | 46 | $2.5 \times 10^4$ | 26 | 3 | $5.0 \times 10^2$ | 2 | 11.5 | 442 |
| a2-c1 | a2 | 8 | 32 | $2.4 \times 10^4$ | 16 | 0 | 0 | 0 | 37.4 | 514 |
| a3-c1 | a3 | 5 | 41 | $3.1 \times 10^4$ | 24 | 1 | 0 | 0 | 19 | 492 |
| a4-c1 | a4 | 49 | 0 | 0 | 6 | 97 | $2.3 \times 10^4$ | 41 | 10.3 | 449 |
| a5-c1 | a5 | 50 | 1 | 0 | 5 | 96 | $3.1 \times 10^4$ | 49 | 28.2 | 541 |
| a6-c1 | a6 | 57 | 0 | 0 | 8 | 78 | $2.1 \times 10^4$ | 16 | 31.2 | 491 |
| a7-c1 | a7 | 32 | 0 | 0 | 7 | 92 | $2.9 \times 10^4$ | 32 | 50.1 | 501 |

TABLE 14

| | | | Elongated inclusions | | | Inclusions including sulfides | | | | |
|---|---|---|---|---|---|---|---|---|---|---|
| | | Fine inclusions | | Volume number | Average equivalent | | Volume number | Average | Martensite phase | |
| Steel sheet No. | Steel No. | Area number density inclusion/mm$^2$ | Number percentage % | density inclusion/ mm$^3$ | circle diameter μm | Number percentage % | density inclusion/ mm$^3$ | concentration of [Ce] + [La] % | Ratio % | Maximum hardness HV |
| B1-c1 | B1 | 38 | 1 | 0 | 8 | 82 | $2.1 \times 10^4$ | 48 | 9.2 | 467 |
| B1-c2 | B1 | 39 | 0 | 0 | 7 | 73 | $2.9 \times 10^4$ | 48 | 9.1 | 659 |
| B2-c1 | B2 | 40 | 0 | 0 | 7 | 88 | $2.2 \times 10^4$ | 49 | 8.9 | 447 |
| B2-c2 | B2 | 35 | 1 | 0 | 6 | 78 | $2.1 \times 10^4$ | 37 | 9.9 | 696 |
| B3-c1 | B3 | 36 | 0 | 0 | 6 | 85 | $2.6 \times 10^4$ | 38 | 18.7 | 574 |
| B3-c2 | B3 | 38 | 0 | 0 | 5 | 83 | $2.0 \times 10^4$ | 35 | 17.9 | 618 |
| B4-c1 | B4 | 42 | 1 | 0 | 6 | 90 | $2.9 \times 10^4$ | 50 | 20.0 | 511 |
| B4-c2 | B4 | 35 | 1 | 0 | 5 | 85 | $2.8 \times 10^4$ | 50 | 18.6 | 661 |
| B5-c1 | B5 | 41 | 0 | 0 | 5 | 81 | $2.3 \times 10^4$ | 48 | 20.9 | 498 |
| B5-c2 | B5 | 42 | 0 | 0 | 5 | 74 | $2.3 \times 10^4$ | 47 | 18.1 | 662 |
| B6-c1 | B6 | 41 | 0 | 0 | 6 | 83 | $2.3 \times 10^4$ | 37 | 29.5 | 502 |
| B6-c2 | B6 | 40 | 0 | 0 | 5 | 85 | $2.7 \times 10^4$ | 48 | 28.4 | 647 |
| B7-c1 | B7 | 39 | 0 | 0 | 6 | 74 | $2.8 \times 10^4$ | 42 | 39.2 | 501 |
| B7-c2 | B7 | 41 | 1 | 0 | 6 | 80 | $2.1 \times 10^4$ | 44 | 36.8 | 634 |
| B8-c1 | B8 | 38 | 0 | 0 | 5 | 81 | $2.6 \times 10^4$ | 50 | 43.8 | 431 |
| B8-c2 | B8 | 45 | 0 | 0 | 8 | 86 | $2.3 \times 10^4$ | 49 | 35.8 | 646 |
| B9-c1 | B9 | 42 | 0 | 0 | 7 | 76 | $2.6 \times 10^4$ | 37 | 41.5 | 504 |
| B9-c2 | B9 | 36 | 0 | 0 | 7 | 81 | $2.8 \times 10^4$ | 46 | 36.0 | 616 |
| b1-c1 | b1 | 4 | 43 | $2.5 \times 10^4$ | 27 | 0 | $5.0 \times 10^2$ | 1 | 8.7 | 428 |
| b2-c1 | b2 | 6 | 35 | $2.3 \times 10^4$ | 21 | 0 | 0 | 0 | 18.5 | 570 |
| b3-c1 | b3 | 6 | 42 | $3.1 \times 10^4$ | 24 | 0 | 0 | 0 | 21.2 | 499 |
| b4-c1 | b4 | 3 | 45 | $2.8 \times 10^4$ | 25 | 0 | $5.0 \times 10^2$ | 1 | 29.0 | 527 |
| b5-c1 | b5 | 6 | 40 | $2.1 \times 10^4$ | 21 | 0 | 0 | 0 | 39.3 | 514 |
| b6-c1 | b6 | 3 | 39 | $2.3 \times 10^4$ | 20 | 0 | 0 | 0 | 42.7 | 445 |
| b7-c1 | b7 | 50 | 1 | 0 | 5 | 92 | $2.2 \times 10^4$ | 72 | 9.1 | 488 |
| b8-c1 | b8 | 62 | 2 | 0 | 6 | 92 | $2.1 \times 10^4$ | 65 | 29.4 | 501 |
| b9-c1 | b9 | 31 | 0 | 0 | 7 | 89 | $2.0 \times 10^4$ | 35 | 57.5 | 424 |
| b10-c1 | b10 | 38 | 0 | 0 | 8 | 82 | $2.5 \times 10^4$ | 27 | 28.0 | 499 |
| b11-c1 | b11 | 36 | 0 | 0 | 6 | 84 | $2.6 \times 10^4$ | 37 | 51.4 | 523 |

TABLE 15

| | | Fine inclusions | Elongated inclusions | | | Inclusions including sulfides | | | Martensite phase | |
|---|---|---|---|---|---|---|---|---|---|---|
| Steel sheet No. | Steel No. | Area number density inclusion/mm$^2$ | Number percentage % | Volume number density inclusion/mm$^3$ | Average equivalent circle diameter μm | Number percentage % | Volume number density inclusion/mm$^3$ | Average concentration of [Ce] + [La] % | Ratio % | Maximum hardness HV |
| C1-h1 | C1 | 41 | 0 | 0 | 8 | 79 | $2.0 \times 10^4$ | 42 | 2.5 | 550 |
| C1-h2 | C1 | 46 | 1 | 0 | 8 | 82 | $2.4 \times 10^4$ | 38 | 2 | 753 |
| C2-h1 | C2 | 37 | 1 | 0 | 5 | 84 | $2.3 \times 10^4$ | 36 | 29 | 515 |
| C2-h2 | C2 | 36 | 1 | 0 | 6 | 81 | $2.5 \times 10^4$ | 39 | 32 | 656 |
| C3-h1 | C3 | 43 | 0 | 0 | 6 | 83 | $2.6 \times 10^4$ | 42 | 42 | 536 |
| C3-h2 | C3 | 46 | 0 | 0 | 5 | 81 | $2.1 \times 10^4$ | 39 | 39 | 672 |
| C4-h1 | C4 | 27 | 1 | 0 | 7 | 85 | $2.2 \times 10^4$ | 34 | 28 | 492 |
| C4-h2 | C4 | 29 | 1 | 0 | 8 | 82 | $2.2 \times 10^4$ | 38 | 26 | 648 |
| C5-h1 | C5 | 41 | 0 | 0 | 6 | 81 | $2.3 \times 10^4$ | 29 | 6 | 543 |
| C5-h2 | C5 | 44 | 0 | 0 | 6 | 80 | $2.1 \times 10^4$ | 31 | 5.5 | 753 |
| C6-h1 | C6 | 44 | 0 | 0 | 7 | 82 | $2.1 \times 10^4$ | 45 | 45 | 556 |
| C6-h2 | C6 | 45 | 0 | 0 | 8 | 80 | $2.3 \times 10^4$ | 43 | 43 | 692 |
| C7-h1 | C7 | 29 | 0 | 0 | 6 | 84 | $2.5 \times 10^4$ | 32 | 29 | 512 |
| C7-h2 | C7 | 31 | 0 | 0 | 7 | 83 | $2.7 \times 10^4$ | 35 | 31 | 656 |
| C8-h1 | C8 | 23 | 1 | 0 | 7 | 87 | $1.7 \times 10^4$ | 41 | 8 | 545 |
| C8-h2 | C8 | 21 | 1 | 0 | 8 | 86 | $1.8 \times 10^4$ | 39 | 9 | 682 |
| C9-h1 | C9 | 78 | 1 | 0 | 8 | 82 | $4.2 \times 10^4$ | 28 | 18 | 584 |
| C9-h2 | C9 | 81 | 1 | 0 | 7 | 77 | $3.6 \times 10^4$ | 26 | 15 | 642 |
| C10-h1 | C10 | 102 | 0 | $1.0 \times 10^3$ | 9 | 78 | $6.4 \times 10^4$ | 22 | 42 | 578 |
| C10-h2 | C10 | 113 | 1 | $1.0 \times 10^3$ | 9 | 82 | $5.9 \times 10^4$ | 23 | 41 | 725 |
| c1-h1 | c1 | 26 | 2 | 0 | 8 | 82 | $1.3 \times 10^4$ | 22 | 43 | 556 |
| c2-h1 | c2 | 11 | 1 | $3.0 \times 10^3$ | 9 | 7 | $3.0 \times 10^3$ | 5 | 25 | 582 |
| c3-h1 | c3 | 27 | 1 | $1.0 \times 10^3$ | 7 | 85 | $1.9 \times 10^4$ | 25 | 26 | 554 |

With regard to the elongated inclusions in the steel sheets, the presence of coarse inclusions was confirmed using an optical microscope, and the area number density of inclusions having an equivalent circle diameter of 2 μm or less with respect to inclusions having an equivalent circle diameter of 0.5 μm or more was investigated through observation using a SEM. Even for inclusions having an elongation ratio of 5 or more, the number percentage, the volume number density, and the average equivalent circle diameter were investigated.

Furthermore, with regard to unelongated inclusions in the steel sheet, the number percentage and volume number density of inclusions having MnS precipitated on oxides or oxysulfides (hard compounds) including at least one of Ce and La with respect to inclusions having an equivalent circle diameter of 1 μm or more, and the average value of the total amount of one or both of Ce and La that are included in the inclusions were investigated.

The investigation results of inclusions in the hot-rolled steel sheets are shown in Tables 7 to 9, and the investigation results of inclusions in the cold-rolled steel sheets are shown in Tables 13 to 15. Meanwhile, in Tables 7 to 9 and Tables 13 to 15, fine inclusions refer to inclusions having an equivalent circle diameter of 0.5 μm to 2 μm, elongated inclusions refer to inclusions having an equivalent circle diameter of 1 μm or more and an elongation ratio of 5 or more, and inclusions including sulfides refer to inclusions that have MnS-based inclusions precipitated on oxides or oxysulfides including at least one of Ce and La and have an equivalent circle diameter of 1 μm or more.

Firstly, the test results of manufacturing of hot-rolled steel sheets will be described with reference to Tables 1 to 9.

In Steel sheet Nos. b9-h1 and c3-h1 in which Steel Nos. b9 and c3 are used, the concentration of C exceeds 0.3%. In Steel sheet No. c1-h1 in which Steel No. c1 is used, the concentration of Mn exceeds 4.0%. In Steel sheet Nos. a6-h1 and b10-h1 in which Steel Nos. a6 and b10 are used, the concentration of the acid-soluble Ti exceeds 0.20%. As a result, in Steel sheet Nos. b9-h1, c3-h1, c1-h1, a6-h1, and b10-h1, elongation and hole expansion were significantly small.

In addition, in Steel sheet No. c2-h1 in which Steel No. c2 was used, the concentration of Si exceeded 2.1%, and ([Ce]+[La])/[acid-soluble Al] was less than 0.02, and therefore hole expansion were small.

In Steel sheet Nos. a7-h1 and b11-h1 in which Steel Sheet Nos. a7 and b11 were used, the concentration of Cr exceeded 2.0%, and therefore elongation was significantly small.

In Steel sheet Nos. a1-h1 to a5-h1 and b1-h1 to b8-h1 in which Steel Nos. a1 to a5 and b1 to b8 were used, ([Ce]+[La])/[5] was less than 0.4, or exceeded 50. Therefore, in the steel sheets, the morphologies of inclusions were not sufficiently controlled, and elongation and hole expansion degraded compared to steel sheets having the same chemical composition except for Ce and La.

In Steel Nos. A1-h2 to A6-h2, B1-h2 to B9-h2, and C1-h2 to C10-h2 in which Steel sheet Nos. A1 to A6, B1 to B9, and C1 to C10 were used, the coiling temperature was lower than 300° C. Therefore, in the above steel sheet Nos., the difference in hardness between martensite and ferrite increased, and hole expansion degraded compared to Steel sheet Nos. A1-h1 to A6-h1, B1-h1 to B9-h1, and C1-h1 to C10-h1 having the same chemical composition.

In Steel Nos. A1-h1 to A6-h1, B1-h1 to B9-h1, and C1-h1 to C10-h1 in which Steel sheet Nos. A1 to A6, B1 to B9, and C1 to C10 were used, the morphologies of inclusions were sufficiently controlled, and therefore elongation and hole expansion were sufficient.

Next, the test results of manufacturing of cold-rolled steel sheets will be described with reference to Tables 1 to 3 and 10 to 15.

Similarly to the test results of manufacturing of hot-rolled steel sheets, in Steel sheet Nos. a6-c1, a7-c1, b9-c1 to b11-c1, c1-c1 to c3-c1 in which Steel Nos. a6, a7, b9 to b11, and c1 to c3 were used, elongation or hole expansion were significantly small.

In addition, in Steel sheet Nos. a1-c1 to a5-c1 and b1-c1 to b8-c1 in which Steel Nos. a1 to a5 and b1 to b8 were used, ([Ce]+[La])/[S] was less than 0.4 or exceeded 50. Therefore, in the steel sheets, the morphologies of inclusions were not sufficiently controlled, and elongation and hole expansion degraded compared to steel sheets having the same chemical composition except for Ce and La.

In Steel Nos. A1-c2 to A6-c2, B1-c2 to B9-c2, and C1-c2 to C10-c2 in which Steel sheet Nos. A1 to A6, B1 to B9, and C1 to C10 were used, the coiling temperature was lower than 300° C. Therefore, in the above steel sheet Nos., the difference in hardness between martensite and ferrite increased, and hole expansion degraded compared to Steel sheet Nos. A1-c1 to A6-c1, B1-c1 to B9-c1, and C1-c1 to C10-c1 having the same chemical composition.

In Steel sheet Nos. A1-c1 to A6-c1, B1-c1 to B9-c1, and C1-c1 to C10-c1 in which Steel sheet Nos. A1 to A6, B1 to B9, and C1 to C10 were used, the morphologies of inclusions were sufficiently controlled, and therefore elongation and hole expansion were sufficient.

INDUSTRIAL APPLICABILITY

According to the present invention, since it is possible to obtain a high-strength steel sheet that can be preferably mainly pressed and used for underbody parts of automobiles and the like and structural materials, and is excellent in terms of hole expansion and ductility, the present invention significantly contributes to steel industry, and has a large industrial availability.

What is claimed is:

1. A high-strength steel sheet comprising, by mass %:
C: 0.03% to 0.30%;
Si: 0.08% to 2.1%;
Mn: 0.5% to 4.0%;
P: 0.05% or less;
S: 0.0001% to 0.1%;
N: 0.01% or less;
acid-soluble Al: more than 0.020% and less than or equal to 2.0%;
acid-soluble Ti: 0.0001% to 0.006%;
at least one selected from Ce and La: 0.001% to 0.04% in total; and
a balance of iron and inevitable impurities,
wherein [Ce], [La], [acid-soluble Al], and [S] satisfy 0.02< ([Ce]+[La])/[acid-soluble Al]<0.25, and 0.4 ([Ce]+[La])/[S]≤50 in a case in which mass percentages of Ce, La, acid-soluble Al, and S are defined to be [Ce], [La], [acid-soluble Al], and [S], respectively, and
a microstructure thereof includes 1% to 50% of martensite in terms of an area ratio.

2. The high-strength steel sheet according to claim 1 further comprising, by mass %, at least one selected from a group consisting of
Cr: 0.001% to 2.0%,
Ni: 0.001% to 2.0%,
Cu: 0.001% to 2.0%,
Nb: 0.001% to 0.2%
V: 0.001% to 1.0%,
W: 0.001% to 1.0%,
Ca: 0.0001% to 0.01%,
Mg: 0.0001% to 0.01%,
Zr: 0.0001% to 0.2%,
at least one selected from Sc and lanthanoids of Pr through Lu: 0.0001% to 0.1% in total,
As: 0.0001% to 0.5%,
Co: 0.0001% to 1.0%,
Sn: 0.0001% to 0.2%,
Pb: 0.0001% to 0.2%,
Y: 0.0001% to 0.2%, and
Hf: 0.0001% to 0.2%.

3. The high-strength steel sheet according to claim 1, wherein [Ce], [La], [acid-soluble Al], and [S] satisfy 0.02≤ ([Ce]+[La])/[acid-soluble Al]<0.15.

4. The high-strength steel sheet according to claim 1, wherein [Ce], [La], [acid-soluble Al], and [S] satisfy 0.02≤ ([Ce]+[La])/[acid-soluble Al]<0.10.

5. The high-strength steel sheet according to claim 1, wherein a number density of inclusions having an equivalent circle diameter of 0.5 μm to 2 μm in the microstructure is 15 inclusions/$mm^2$ or more.

6. The high-strength steel sheet according to claim 1, wherein, of inclusions having an equivalent circle diameter of 1.0 μm or more in the microstructure, a number percentage of elongated inclusions having an aspect ratio of 5 or more obtained by dividing a long diameter by a short diameter is 20% or less.

7. The high-strength steel sheet according to claim 1, wherein, of inclusions having an equivalent circle diameter of 1.0 μm or more in the microstructure, a number percentage of inclusions having at least one of MnS, TiS, and (Mn, Ti)S precipitated to an oxide or oxysulfide composed of at least one of Ce and La, and at least one of O and S, or an oxide or oxysulfide composed of at least one of Ce and La, at least one of Si and Ti, and at least one of O and S is 10% or more.

8. The high-strength steel sheet according to claim 1, wherein a volume number density of elongated inclusions having an equivalent circle diameter of 1 μm or more, and an aspect ratio of 5 or more obtained by dividing a long diameter by a short diameter is $1.0\times10^4$ inclusions/$mm^3$ or less in the microstructure.

9. The high-strength steel sheet according to claim 1, wherein, in the microstructure, a volume number density of inclusions having at least one of MnS, TiS, and (Mn, Ti)S precipitated in an oxide or oxysulfide composed of at least one of Ce and La, and at least one of O and S, or an oxide or oxysulfide composed of at least one of Ce and La, at least one of Si and Ti, and at least one of 0 and S is $1.0\times10^3$ inclusions/$1=^3$ or more.

10. The high-strength steel sheet according to claim 1, wherein elongated inclusions having an equivalent circle diameter of 1 μm or more, and an aspect ratio of 5 or more obtained by dividing a long diameter by a short diameter are present in the microstructure, and an average equivalent circle diameter of the elongated inclusions is 10 μm or less.

11. The high-strength steel sheet according to claim 1, wherein inclusions having at least one of MnS, TiS, and (Mn, Ti)S precipitated to an oxide or oxysulfide composed of at least one of Ce and La, and at least one of O and S, or an oxide or oxysulfide composed of at least one of Ce and La, at least one of Si and Ti, and at least one of O and S are present in the microstructure, and the inclusions include a total of 0.5 mass % to 95 mass % of at least one of Ce and La in terms of an average composition.

12. The high-strength steel sheet according to claim 1, wherein an average grain size in the microstructure is 10 μm or less.

13. The high-strength steel sheet according to claim 1, wherein a maximum hardness of martensite included in the microstructure is 600 Hv or less.

14. The high-strength steel sheet according to claim 1, wherein a sheet thickness thereof is 0.5 mm to 20 mm.

15. The high-strength steel sheet according to claim 1, further comprising a galvanized layer or a galvannealed layer on at least one surface.

16. A method of manufacturing a high-strength steel sheet, the method comprising:

a first process in which a molten steel having the chemical components according to claim 1 is subjected to a continuous casting so as to be processed into a slab;

a second process in which a hot rolling is carried out on the slab in a finishing temperature of 850° C. to 970° C., and a steel sheet is manufactured; and a third process in which the steel sheet is cooled to a cooling control temperature of 450° C. or lower at an average cooling rate of 10 to 100° C./second, and then coiled at a coiling temperature of 300° C. to 450° C., wherein a hot-rolled steel sheet is manufactured.

17. The method of manufacturing the high-strength steel sheet according to claim 16, wherein galvanizing or galvannealed is carried out on at least one surface of the hot-rolled steel sheet.

18. The method of manufacturing the high-strength steel sheet according to claim 16, wherein galvanizing or galvannealed is carried out on at least one surface of the cold-rolled steel sheet.

19. The method of manufacturing the high-strength steel sheet according to claim 1, wherein the slab is reheated to 1100° C. or higher after the first process and before the second process.

* * * * *